US007554490B2

(12) United States Patent
Baliarda et al.

(10) Patent No.: US 7,554,490 B2
(45) Date of Patent: Jun. 30, 2009

(54) SPACE-FILLING MINIATURE ANTENNAS

(75) Inventors: Carles Puente Baliarda, Barcelona (ES); Edouard Jean Louis Rozan, Barcelona (ES); Jaume Anguera Pros, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

(21) Appl. No.: 11/686,804

(22) Filed: Mar. 15, 2007

(65) Prior Publication Data

US 2007/0152886 A1 Jul. 5, 2007

Related U.S. Application Data

(60) Division of application No. 11/179,250, filed on Jul. 12, 2005, now Pat. No. 7,202,822, which is a continuation of application No. 11/110,052, filed on Apr. 20, 2005, now Pat. No. 7,148,850, which is a continuation of application No. 10/182,635, filed as application No. PCT/EP00/00411 on Jan. 19, 2000, now abandoned.

(51) Int. Cl.
*H01Q 1/38* (2006.01)
*H01Q 1/24* (2006.01)

(52) U.S. Cl. ..... 343/700 MS; 343/702

(58) Field of Classification Search ..... 705/1, 705/10, 14, 35, 37, 38, 40; 343/700 MS, 343/702, 895, 767, 741
See application file for complete search history.

(56) References Cited

U.S. PATENT DOCUMENTS

| | | | |
|---|---|---|---|
| 3,521,284 | A | 7/1971 | Shelton, Jr. et al. |
| 3,599,214 | A | 8/1971 | Altmayer |
| 3,622,890 | A | 11/1971 | Fujimoto et al. |
| 3,683,379 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,021,810 | A | 5/1977 | Urpo et al. |
| 4,024,542 | A | 5/1977 | Ikawa et al. |
| 4,072,951 | A | 2/1978 | Kaloi |
| 4,131,893 | A | 12/1978 | Munson et al. |

(Continued)

FOREIGN PATENT DOCUMENTS

| | | |
|---|---|---|
| AU | 5984099 | 4/2001 |

(Continued)

OTHER PUBLICATIONS

Puente, C. et al., "Multiband properties of a fractal tree antenna generated by electrochemical deposition," Electronics Letters, IEE Stevenage, GB, vol. 32, No. 25, pp. 2298-2299, Dec. 5, 1996.

(Continued)

*Primary Examiner*—Hoang V Nguyen
(74) *Attorney, Agent, or Firm*—Howison & Arnott, LLP

(57) ABSTRACT

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

25 Claims, 25 Drawing Sheets

U.S. PATENT DOCUMENTS

| | | | |
|---|---|---|---|
| 4,141,016 | A | 2/1979 | Nelson |
| 4,381,566 | A | 4/1983 | Kane |
| 4,471,358 | A | 9/1984 | Glasser |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |
| 4,590,614 | A | 5/1986 | Erat |
| 4,623,894 | A | 11/1986 | Lee et al. |
| 4,628,322 | A | 12/1986 | Marko et al. |
| 4,673,948 | A | 6/1987 | Kuo |
| 4,723,305 | A | 2/1988 | Phillips et al. |
| 4,730,195 | A | 3/1988 | Phillips et al. |
| 4,827,266 | A | 5/1989 | Sato |
| 4,839,660 | A | 6/1989 | Hadzoglou |
| 4,843,468 | A | 6/1989 | Drewery |
| 4,847,629 | A | 7/1989 | Shimazaki |
| 4,849,766 | A | 7/1989 | Inaba et al. |
| 4,857,939 | A | 8/1989 | Shimazaki |
| 4,890,114 | A | 12/1989 | Egashira |
| 4,894,663 | A | 1/1990 | Urbish et al. |
| 4,907,011 | A | 3/1990 | Kuo |
| 4,912,481 | A | 3/1990 | Mace et al. |
| 4,975,711 | A | 12/1990 | Lee |
| 5,030,963 | A | 7/1991 | Tadama |
| 5,138,328 | A | 8/1992 | Zibrik et al. |
| 5,168,472 | A | 12/1992 | Lockwood |
| 5,172,084 | A | 12/1992 | Fiedzuiszko et al. |
| 5,200,756 | A | 4/1993 | Feller |
| 5,214,434 | A | 5/1993 | Hsu |
| 5,218,370 | A | 6/1993 | Blaese |
| 5,227,804 | A | 7/1993 | Oda |
| 5,227,808 | A | 7/1993 | Davis |
| 5,245,350 | A | 9/1993 | Sroka |
| 5,248,988 | A | 9/1993 | Makimo |
| 5,255,002 | A | 10/1993 | Day |
| 5,257,032 | A | 10/1993 | Diamond et al. |
| 5,337,065 | A | 8/1994 | Bonnet |
| 5,347,291 | A | 9/1994 | Moore |
| 5,355,144 | A | 10/1994 | Walton et al. |
| 5,355,318 | A | 10/1994 | Dionnet et al. |
| 5,373,300 | A | 12/1994 | Jenness et al. |
| 5,402,134 | A | 3/1995 | Miller et al. |
| 5,420,599 | A | 5/1995 | Erkocevic |
| 5,422,651 | A | 6/1995 | Chang |
| 5,451,965 | A | 9/1995 | Matsumoto |
| 5,451,968 | A | 9/1995 | Emery |
| 5,453,751 | A | 9/1995 | Tsukamoto et al. |
| 5,457,469 | A | 10/1995 | Diamond et al. |
| 5,471,224 | A | 11/1995 | Barkeshli |
| 5,493,702 | A | 2/1996 | Crowley et al. |
| 5,495,261 | A | 2/1996 | Baker et al. |
| 5,508,709 | A | 4/1996 | Krenz et al. |
| 5,534,877 | A | 7/1996 | Sorbello et al. |
| 5,537,367 | A | 7/1996 | Lockwood et al. |
| 5,569,879 | A | 10/1996 | Gloton et al. |
| H001631 | H | 2/1997 | Montgomery et al. |
| 5,619,205 | A | 4/1997 | Johnson |
| 5,684,672 | A | 11/1997 | Karidis et al. |
| 5,712,640 | A | 1/1998 | Andou et al. |
| 5,767,811 | A | 6/1998 | Mandai et al. |
| 5,784,032 | A | 7/1998 | Johnston et al. |
| 5,798,688 | A | 8/1998 | Schofield |
| 5,821,907 | A | 10/1998 | Zhu et al. |
| 5,838,285 | A | 11/1998 | Tay |
| 5,841,403 | A | 11/1998 | West |
| 5,870,066 | A | 2/1999 | Asakura et al. |
| 5,872,546 | A | 2/1999 | Ihara et al. |
| 5,898,404 | A | 4/1999 | Jou |
| 5,903,240 | A | 5/1999 | Kawahata et al. |
| 5,926,141 | A | 7/1999 | Lindenmeier et al. |
| 5,936,583 | A | 8/1999 | Sekine et al. |
| 5,943,020 | A | 8/1999 | Liebendoerfer et al. |
| 5,966,098 | A | 10/1999 | Qi et al. |
| 5,973,651 | A | 10/1999 | Suesada et al. |
| 5,986,609 | A | 11/1999 | Spall |
| 5,986,610 | A | 11/1999 | Miron |
| 5,986,615 | A | 11/1999 | Westfall et al. |
| 5,990,838 | A | 11/1999 | Burns et al. |
| 5,995,052 | A | 11/1999 | Sadler et al. |
| 6,002,367 | A | 12/1999 | Engblom et al. |
| 6,005,524 | A | 12/1999 | Hayes et al. |
| 6,016,130 | A | 1/2000 | Annamaa |
| 6,028,568 | A | 2/2000 | Asakura et al. |
| 6,031,499 | A | 2/2000 | Dichter |
| 6,031,505 | A | 2/2000 | Qi et al. |
| 6,040,803 | A | 3/2000 | Spall |
| 6,058,211 | A | 5/2000 | Bormans |
| 6,069,592 | A | 5/2000 | Wass |
| 6,075,489 | A | 6/2000 | Sullivan |
| 6,075,500 | A | 6/2000 | Kurz et al. |
| 6,078,294 | A | 6/2000 | Mitarai |
| 6,091,365 | A | 7/2000 | Derneryd et al. |
| 6,097,345 | A | 8/2000 | Walton |
| 6,104,349 | A | 8/2000 | Cohen |
| 6,111,545 | A | 8/2000 | Saari |
| 6,127,977 | A | 10/2000 | Cohen |
| 6,131,042 | A | 10/2000 | Lee et al. |
| 6,140,969 | A | 10/2000 | Lindenmeier et al. |
| 6,140,975 | A | 10/2000 | Cohen |
| 6,147,649 | A | 11/2000 | Ivrissimtzis |
| 6,147,652 | A | 11/2000 | Sekine |
| 6,157,344 | A | 12/2000 | Bateman |
| 6,160,513 | A | 12/2000 | Davidson et al. |
| 6,172,618 | B1 | 1/2001 | Hazokai et al. |
| 6,181,281 | B1 | 1/2001 | Desclos et al. |
| 6,181,284 | B1 | 1/2001 | Madsen et al. |
| 6,211,824 | B1 | 4/2001 | Holden et al. |
| 6,211,889 | B1 | 4/2001 | Stoutamire |
| 6,218,992 | B1 | 4/2001 | Sadler et al. |
| 6,236,372 | B1 | 5/2001 | Lindenmeier et al. |
| 6,243,592 | B1 | 6/2001 | Nakada et al. |
| 6,266,023 | B1 | 7/2001 | Nagy et al. |
| 6,272,356 | B1 | 8/2001 | Dolman et al. |
| 6,281,846 | B1 | 8/2001 | Puente Baliarda et al. |
| 6,281,848 | B1 | 8/2001 | Nagumo |
| 6,285,342 | B1 | 9/2001 | Brady et al. |
| 6,292,154 | B1 | 9/2001 | Deguchi et al. |
| 6,300,910 | B1 | 10/2001 | Kim |
| 6,300,914 | B1 | 10/2001 | Yang |
| 6,301,489 | B1 | 10/2001 | Winstead et al. |
| 6,307,511 | B1 | 10/2001 | Ying et al. |
| 6,307,512 | B1 | 10/2001 | Geeraert |
| 6,327,485 | B1 | 12/2001 | Waldron |
| 6,329,951 | B1 | 12/2001 | Wen et al. |
| 6,329,954 | B1 | 12/2001 | Fuchs et al. |
| 6,329,962 | B2 | 12/2001 | Ying |
| 6,333,716 | B1 | 12/2001 | Pontoppidan |
| 6,343,208 | B1 | 1/2002 | Ying |
| 6,346,914 | B1 | 2/2002 | Annamaa |
| 6,353,443 | B1 | 3/2002 | Ying |
| 6,360,105 | B2 | 3/2002 | Nakada et al. |
| 6,367,939 | B1 | 4/2002 | Carter et al. |
| 6,373,447 | B1 | 4/2002 | Rostoker et al. |
| 6,380,902 | B2 | 4/2002 | Duroux |
| 6,388,626 | B1 | 5/2002 | Gamalielsson et al. |
| 6,407,710 | B2 | 6/2002 | Keilen et al. |
| 6,408,190 | B1 | 6/2002 | Ying |
| 6,417,810 | B1 | 7/2002 | Huels et al. |
| 6,417,816 | B2 | 7/2002 | Sadler et al. |
| 6,421,013 | B1 | 7/2002 | Chung |
| 6,431,712 | B1 | 8/2002 | Turnbull |
| 6,445,352 | B1 | 9/2002 | Cohen |

| | | | | |
|---|---|---|---|---|
| 6,452,549 | B1 | 9/2002 | Lo | |
| 6,452,553 | B1 | 9/2002 | Cohen | |
| 6,476,766 | B1 | 11/2002 | Cohen | |
| 6,483,462 | B2 | 11/2002 | Weinberger | |
| 6,496,154 | B2 | 12/2002 | Gyenes | |
| 6,525,691 | B2 | 2/2003 | Varadan et al. | |
| 6,538,604 | B1 | 3/2003 | Isohatala | |
| 6,552,690 | B2 | 4/2003 | Veerasamy | |
| 6,603,434 | B2 | 8/2003 | Lindenmeier et al. | |
| 6,697,024 | B2 | 2/2004 | Fuerst et al. | |
| 6,707,428 | B2 | 3/2004 | Gram | |
| 6,756,944 | B2 | 6/2004 | Tessier et al. | |
| 6,784,844 | B1 | 8/2004 | Boakes et al. | |
| 6,839,040 | B2 | 1/2005 | Huber et al. | |
| 6,928,413 | B1 * | 8/2005 | Pulitzer | 705/14 |
| 2001/0002823 | A1 | 6/2001 | Ying | |
| 2001/0050636 | A1 | 12/2001 | Weinberger | |
| 2002/0000940 | A1 | 1/2002 | Moren et al. | |
| 2002/0109633 | A1 | 8/2002 | Ow et al. | |
| 2002/0175879 | A1 | 11/2002 | Sabet | |
| 2003/0090421 | A1 | 5/2003 | Sajadinia | |

FOREIGN PATENT DOCUMENTS

| | | | |
|---|---|---|---|
| DE | 3337941 | | 5/1985 |
| DE | 101 42 965 | | 3/2003 |
| EP | 0096847 | | 12/1983 |
| EP | 0297813 | | 1/1989 |
| EP | 0358090 | | 3/1990 |
| EP | 0396033 | A2 | 11/1990 |
| EP | 0543645 | | 5/1993 |
| EP | 0571124 | | 11/1993 |
| EP | 0620677 | A1 | 10/1994 |
| EP | 0688040 | | 12/1995 |
| EP | 0825672 | A2 | 2/1996 |
| EP | 0736926 | A1 | 10/1996 |
| EP | 0765001 | | 3/1997 |
| EP | 0823748 | A2 | 8/1997 |
| EP | 0825672 | A2 | 8/1997 |
| EP | 0814536 | | 12/1997 |
| EP | 0823748 | A2 | 2/1998 |
| EP | 0 843 905 | | 5/1998 |
| EP | 0871238 | | 10/1998 |
| EP | 0892459 | | 1/1999 |
| EP | 0929121 | | 7/1999 |
| EP | 0932219 | | 7/1999 |
| EP | 0938158 | A2 | 8/1999 |
| EP | 0942488 | | 9/1999 |
| EP | 0969375 | | 1/2000 |
| EP | 0986130 | | 3/2000 |
| EP | 0997974 | | 5/2000 |
| EP | 1011167 | A1 | 6/2000 |
| EP | 1016158 | B1 | 7/2000 |
| EP | 1018777 | | 7/2000 |
| EP | 1018779 | | 7/2000 |
| EP | 1 024 552 | | 8/2000 |
| EP | 1 026 774 | | 8/2000 |
| EP | 1071161 | | 1/2001 |
| EP | 1079462 | | 2/2001 |
| EP | 1 083 623 | | 3/2001 |
| EP | 1083624 | | 3/2001 |
| EP | 1 091 446 | | 4/2001 |
| EP | 1094545 | | 4/2001 |
| EP | 1096602 | | 5/2001 |
| EP | 1 126 522 | | 8/2001 |
| EP | 1148581 | | 10/2001 |
| EP | 1198027 | | 4/2002 |
| EP | 1237224 | | 9/2002 |
| EP | 1267438 | | 12/2002 |
| EP | 0924793 | B1 | 3/2003 |
| EP | 1 317 018 | | 6/2003 |
| EP | 1 326 302 | | 7/2003 |
| EP | 1 374 336 | | 1/2004 |
| EP | 1 396 906 | | 3/2004 |
| EP | 1 414 106 | | 4/2004 |
| EP | 1 453 140 | | 9/2004 |
| EP | 0843905 | B1 | 12/2004 |
| EP | 1515392 | A2 | 3/2005 |
| ES | 2112163 | | 3/1998 |
| ES | 2142280 | | 5/1998 |
| ES | 200001508 | | 1/2002 |
| FR | 2543744 | | 10/1984 |
| FR | 2704359 | | 10/1994 |
| FR | 2837339 | | 9/2003 |
| GB | 1313020 | | 8/1971 |
| GB | 2 161 026 | | 1/1986 |
| GB | 2215136 | | 9/1989 |
| GB | 2 293 275 | | 3/1996 |
| GB | 2330951 | | 5/1999 |
| GB | 2355116 | | 4/2001 |
| JP | 55-147806 | | 11/1980 |
| JP | 5007109 | | 1/1993 |
| JP | 5129816 | | 5/1993 |
| JP | 5267916 | | 10/1993 |
| JP | 5347507 | | 12/1993 |
| JP | 6204908 | | 7/1994 |
| JP | 773310 | | 3/1995 |
| JP | 8052968 | A1 | 2/1996 |
| JP | 09-069718 | | 3/1997 |
| JP | 9 199 939 | | 7/1997 |
| JP | 10209744 | | 8/1998 |
| SE | 5 189 88 | | 12/2002 |
| WO | 93/12559 | | 6/1993 |
| WO | 95/11530 | | 4/1995 |
| WO | 96/27219 | | 9/1996 |
| WO | 96/29755 | | 9/1996 |
| WO | 96/68881 | | 12/1996 |
| WO | 97/06578 | | 2/1997 |
| WO | 97/07557 | | 2/1997 |
| WO | 97/11507 | | 3/1997 |
| WO | 97/32355 | | 9/1997 |
| WO | 97/33338 | | 9/1997 |
| WO | 97/35360 | | 9/1997 |
| WO | 97/47054 | | 12/1997 |
| WO | 98/12771 | | 3/1998 |
| WO | 98/36469 | | 8/1998 |
| WO | 99/03166 | | 1/1999 |
| WO | 99/03167 | | 1/1999 |
| WO | 99/25042 | | 5/1999 |
| WO | 99/25044 | | 5/1999 |
| WO | 99/27608 | | 6/1999 |
| WO | 9943039 | A1 | 8/1999 |
| WO | 99/56345 | | 11/1999 |
| WO | 00/01028 | | 1/2000 |
| WO | 00/03167 | | 1/2000 |
| WO | 00/03453 | | 1/2000 |
| WO | 00/22695 | | 4/2000 |
| WO | 0025266 | A1 | 5/2000 |
| WO | 00/36700 | | 6/2000 |
| WO | 0034916 | A1 | 6/2000 |
| WO | 00/49680 | | 8/2000 |
| WO | 00/52784 | | 9/2000 |
| WO | 00/52787 | | 9/2000 |
| WO | 00/65686 | | 11/2000 |
| WO | 00/77884 | | 12/2000 |
| WO | 0077728 | A1 | 12/2000 |
| WO | 01/03238 | | 1/2001 |
| WO | 01/05048 | | 1/2001 |
| WO | 01/82410 | | 1/2001 |
| WO | 01/08254 | | 2/2001 |
| WO | 01/08257 | | 2/2001 |
| WO | 01/08260 | | 2/2001 |
| WO | 01/11721 | | 2/2001 |
| WO | 01/13464 | | 2/2001 |
| WO | 0108093 | A1 | 2/2001 |
| WO | 01/15271 | | 3/2001 |

| | | |
|---|---|---|
| WO | 01/17063 | 3/2001 |
| WO | 01/17064 | 3/2001 |
| WO | 01/20714 | 3/2001 |
| WO | 01/20927 | 3/2001 |
| WO | 01/22528 | 3/2001 |
| WO | 01/24314 | 4/2001 |
| WO | 01/26182 | 4/2001 |
| WO | 01/28035 | 4/2001 |
| WO | 01/31739 | 5/2001 |
| WO | 01/33663 | 5/2001 |
| WO | 01/33664 | 5/2001 |
| WO | 01/33665 | 5/2001 |
| WO | 01/35491 | 5/2001 |
| WO | 01/35492 | 5/2001 |
| WO | 01/37370 | 5/2001 |
| WO | 01/41252 | 6/2001 |
| WO | 01/47056 | 6/2001 |
| WO | 01/48860 | 7/2001 |
| WO | 01/48861 | 7/2001 |
| WO | 01/54225 | 7/2001 |
| WO | 01/65636 | 9/2001 |
| WO | 01/73890 | 10/2001 |
| WO | 01/78192 | 10/2001 |
| WO | 01/86753 | 11/2001 |
| WO | 01/89031 | 11/2001 |
| WO | 02/35646 | 5/2002 |
| WO | 02/35652 | 5/2002 |
| WO | 02/078121 | 10/2002 |
| WO | 02/078123 | 10/2002 |
| WO | 02/078124 | 10/2002 |
| WO | 02/080306 | 10/2002 |
| WO | 02/084790 | 10/2002 |
| WO | 02/091518 | 11/2002 |
| WO | 02/095874 | 11/2002 |
| WO | 02/096166 | 11/2002 |
| WO | 03/017421 | 2/2003 |
| WO | 03/023900 | 3/2003 |

OTHER PUBLICATIONS

Puente, C. et al., "Small but long Koch fractal monopole," Electronics Letters, IEE Stevenage, GB, vol. 34, No. 1, pp. 9-10, Jan. 8, 1998.

Puente Baliarda, Carles et al., "The Koch Monopole: A Small Fractal Antenna," IEEE Transactions on Antennas and Propagation, New York, vol. 48, No. 11, pp. 1773-1781, Nov. 1, 2000.

Cohen, Nathan, "Fractal Antenna Applications in Wireless Telecommunications," Electronic Industries Forum of New England, 1997, Professional Program Proceedings, Boston, Massachusetts, May 6-8, 1997, IEEE, pp. 43-49, New York, New York, May 6, 1997.

Anguera, J. et al., "Miniature Wideband Stacked Microstrip Patch Antenna Based on the Sierpinski Fractal Geometry," IEEE Antennas and Propagation Society International Symposium, 2000 Digest Aps., vol. 3 of 4, pp. 1700-1703, Jul. 16, 2000.

Hara Prasad, R.V. et al., "Microstrip Fractal Patch Antenna for Multi-Band Communication," Electronics Letter, IEE Stevenage, GB, vol. 36, No. 14, pp. 1179-1180, Jul. 6, 2000.

Borja, C. et a., "High Directivity Fractal Boundary Microstrip Patch Antenna," Electronics Letters, IEE Stevenage, GB, vol. 36, No. 9, pp. 778-779, Apr. 27, 2000.

Hansen, R.C., "Fundamental Limitations in Antennas," Proceedings of the IEEE, vol. 69, No. 2, pp. 170-182, Feb. 1981.

Jaggard, Dwight L., "Fractal Electrodynamics and Modeling," Direction in Electromagnetic Wave Modeling, pp. 435-446, 1991.

Hohlfeld, Robert G. et al., "Self-Similarity and the Geometric Requirements for Frequency Independence in Antennae," Fractals, vol. 7, No. 1, pp. 79-84, 1999.

Samavati, Hirad et al., "Fractal Capacitors," IEEE Journal of Solid-State Circuits, vol. 33, No. 12, pp. 2035-2041, Dec. 1998.

Pribetich, P. et al. "Quasifractal Planar Microstrip Resonators for Microwave Circuits," Microwave and Optical Technology Letters, vol. 21, No. 6, pp. 443-436, Jun. 20, 1999.

Zhang, Dawei, et al., "Narrowband Lumped-Element Microstrip Filters Using Capacitively-Loaded Inductors," IEEE MTT-S Microwave Symposium Digest, pp. 379-382, May 16, 1995.

Gough C.E. et al., "High Te coplanar resonators for microwave applications and scientific studies," Physics C, NL, North-Holland Publishing, Amsterdam, vol. 282-287, No. 2001, pp. 395-398, Aug. 1, 1997.

Book by H. Meinke and F. V. Gundlah, Radio Engineering Reference, vol. 1, Radio components. Circuits with lumped parameters. Transmission lines. Wave-guides. Resonators. Arrays. Radio wave propagation, States Energy Publishing House, Moscow, with English translation, 4 pages, 1961.

V. A. Volgov, "Parts and Units of Radio Electronic Equipment (Design & Computation)," Energiya, Moscow, with English translation, 4 pages, 1967.

Ali, M. et al., "A Triple-Band Internal Antenna for Mobile Hand-held Terminals," IEEE, pp. 32-35, 1992.

Romeu, Jordi et al., "A Three Dimensional Hilbert Antenna," IEEE, pp. 550-553, 2002.

Parker et al., "Convoluted Array Elements and Reduced Size Unit Cells for Frequency-Sleective Surfaces," Microwave, Antennas & Propagation, IEEE Proceedings H, vol. 138, No. 1, pp. 19-22, Feb. 1991.

Sanad, Mohamed, "A Compact Dual-Broadband Microstrip Antenna Having Both Stacked and Planar Parasitic Elements," IEEE Antennas and Propagation Society International Symposium 1996 Digest, pp. 6-9, Jul. 21-26, 1996.

European Patent Office Communication from the corresponding European patent application dated Feb. 7, 2003, 10 pages.

Dr. Carles Puente Baliarda; Fractal Antennas; Ph. D. Dissertation; May 1997; Cover page—p. 270; Electromagnetics and Photonics Engineering group, Dept. of Signal Theory and Communications, Universtat Poltecnica de Catalunya; Barcelona, Spain.

Oscar Campos Escala; Study of Multiband and Miniature Fractal Antennas; Final Year Project; Cover Page—119 plus translation; Superior Technical Engineering School of Telecommunications, Barcelona Polytechnic University, Barcelona, Spain.

Oriol Verdura Contrras; Fractal Miniature Antenna; Final Year Project; Sep. 1997; Cover Page—61 plus translation; UPC Baix Llobregat Polytechnic university; Barcelona Spain.

E.A. Parker and A.N.A. El Sheikh; Convoluted Dipole Array Elements; Electronic Letters; Feb. 14, 1001; pp. 322-333; vol. 27, No. 4; IEE; United Kingdom.

Carmen Borja Borau; Antennas Fractales Microstrip (Microstrip Fractal Antennas); Thesis; 1997; Cover Page—Biblografia p. 3 (261 pages); E.T.X. d'Enginyeria de Telecomunicacio; Barcelona, Spain.

Chien-Jen Wang and Christina F. Jou, "Compact Microstrip Meander Antenna," IEEE Microwave and Optical Technology Letters, vol. 22, No. 6, pp. 413-414, Sep. 20, 1999.

H.Y. Wang and M.J. Lancaster,"Aperture-Coupled Thin-Film Superconducting Meander Antennas," IEEE Transactions on Antennas and Propagation, vol. 47, No. 5, pp. 829-836, May 1999.

Christian Braun, Gunnar Engblom and Claes Beckman, "Antenna Diversity for Mobile Telephones," AP-S IEEE, pp. 2220-2223, Jun. 1998.

R.B. Waterhouse, D.M. Kokotoff and F. Zavosh, "Investigation of Small Printed Antennas Suitable for Mobile Communication Handsets," AP-S IEEE, pp. 1946-1949, Jun. 1998.

Terry Kin-Chung Lo and Yeongming Hwang, "Bandwidth Enhancement of PIFA Loaded with Very High Permitivity Material Using FDTD," AP-S IEEE, pp. 798-801, Jun. 1998.

Jui-Han Lu and Kai-Ping Yang, "Slot-Coupled Compact Triangular Microstrip Antenna With Lumped Load," AP-S IEEE, pp. 916-919, Jun. 1998.

Hua-Ming Chen and Kin-Lu Wong, "On the Circular Plarization Operation of Annular-Ring Microstrip Antennas," IEEE Transactions on Antennas and Propagation, vol. 47, No. 8, pp. 1289-1292, Aug. 1999.

Choon Sae Lee and Vahakn Nalbandian, "Planar Circularly Polarized Microstrip Antenna with a Single Feed," IEEE Transactions on Antennas and Propagation, vol. 47, No. 6, pp. 1005-1007, Jun. 1999.

Chih-Yu Huang, Jian-Yi Wu and Kin-Lu Wong, "Cross-Slot-Coupled Microstrip Antenna and Dielectric Resonator Antenna for Circular Polarization," IEEE Transactions on Antennas and Propagation, vol. 47, No. 4, pp. 605-609, Apr. 1999.
David M. Kokotoff, James T. Aberle and Rod B. Waterhouse, "Rigorous Analysis of Probe-Fed Printed Annular Ring Antennas," IEEE Transactions on Antennas and Propagation, vol. 47, No. 2, pp. 384-388, Feb. 1999.
Rod Be Waterhouse, S.D. Targonski and D.M. Kokotoff, Design and Performance of Small Printed Antennas, IEEE Transactions on Antennas and Propagation, vol. 46, No. 11, pp. 1629-1633, Nov. 1998.
Yan Wai Chow, Edward Kai Ning Yung, Kim Fung Tsand and Hon Tat Hiu, "An Innovative Monopole Antenna for Mobile-Phone Handsets," Microwave and Optical Technology Letters, vol. 25, No. 2, pp. 119-121, Apr. 20, 2000.
Wen-Shyang Chen, "Small Circularly Polarized Microstrip Antennas," AP-S IEEE, pp. 1-3, Jul. 1999.
W.K. Lam and Edward K.N. Yung, "A Novel Leaky Wave Antenna for the Base Station in an Innovative Indoors Cellular Mobile Communication System," AP-S IEEE, Jul. 1999.
H. Iwasaki, "A circularly Polarized Small-Size Microstrop Antenna with a Cross Slot," IEEE Transactions on Antennas and Propagation, vol. 44, No. 10, pp. 1399-1401, Oct. 1996.
Choon Sae Lee and Pi-Wei Chen, "Electrically Small Microstrip Antennas," IEEE, 2000.
Jui-Han Lu, Chia-Luan Tang and Kin-Lu Wong, "Slot-Coupled Small Triangular Microstrip Antenna," Microwave and Optical Technology Letters, vol. 16, No. 6, pp. 371-374, Dec. 20, 1997.
Chia-Luan Tang, Hong-Twu Chen and Kin-Lu Wong, "Small Circular Microstrip Antenna with Dual-Frequency Operation," IEEE Electronic Letters, vol. 33, pp. 1112-1113, Jun. 10, 1997.
R. Waterhouse, "Small Microstrip Patch Antenna," IEEE Electronic Letters, vol. 31, pp. 604-605, Feb. 21, 1995.
R. Waterhouse, "Small Printed Antenna Easily Integrated Into a Mobile Handset Terminal," IEEE Electronic Letters, vol. 34, No. 17, pp. 1629-1631, Aug. 20, 1998.
O. Leisten, Y. Vardaxoglou, T. Schmid, B. Rosenberger, E. Agboraw, N. Kuster and G. Nicolaidis, "Miniature Dielectric-Loaded Personal Telephone Antennas with Low User Exposure," IEEE Electronic Letters, vol. 34, No. 17, pp. 1628-2629, Aug. 20, 1998.
Hua-Ming Chen, "Dual-Frequency Microstrip Antenna with Embedded Reactive Loading," IEEE Microwave and Optical Technology Letters, vol. 23, No. 3, pp. 186-188, Nov. 5, 1999.
Shyh-Timg Fang and Kin-Lu Wong, "A Dual Frequency Equilateral-Traingular Microstrip Antenna with a Pair of Narrow Slots," IEEE Microwave and Optical Technology Letters, vol. 23, No. 2, pp. 82-84, Oct. 20, 1999.
Kin-Lu Wong and Kai-Ping Yang, "Modified Planar Inverter F. Antenna," IEE Electronic Letters, vol. 34, No. 1, pp. 7-8, Jan. 8, 1998.
S.K. Palit, A. Hamadi and D. Tan, "Design of a Wideband Dual-Frequency Notched Microstrip Antenna," AP-S IEEE, pp. 2351-2354, Jun. 1998.
T. Williams, M. Rahman and M.A. Stuchly, "Dual-Band Meander Antenna for Wireless Telephones," IEEE Microwave and Optical Technology Letters, vol. 24, No. 2, pp. 81-85, Jan. 20, 2000.
Nathan Cohen, "Fractal Antennas, Part 1," Communications Quarterly: The Journal of Communications Technology, pp. 7-22, Summer, 1995.
Nathan Cohen, "Fractal and Shaped Dipoles," Communications Quarterly: The Journal of Communications Technology, pp. 25-36, Spring 1995.
Nathan Cohen, "Fractal Antennas, Part 2," Communications Quarterly: The Journal of Communications Technology, pp. 53-66, Summer 1996.
John P. Gianvittorio and Yahya Rahmat-Samii, Fractal Element Antennas; A Compilation of Configurations with Novel Characteristics, IEEE, 2000.
Jacob George, C.K. Aanandan, P. Mohanan and K.G. Nair, "Analysis of a New Compact Microstrip Antenna," IEEE Transactions on Antennas and Propagation, vol. 46, No. 11, pp. 1712-1717, Nov. 1998.
Jungmin Chang and Sangseol Lee, "Hybrid Fractal Cross Antenna," IEEE Microwave and Optical Technology Letters, vol. 25, No. 6, pp. 429-435, Jun. 20, 2000.
Jaume Anguera, Carles Puente, Carmen Borja, Jordi Romeu and Marc Aznar, "Antenas Microstrip Apiladas con Geometria de Anillo," Proceedings of the XIII National Symposium of the Scientific International Union of Radio, URSI '00, Zaragoza, Spain, Sep. 2000.
C. Puente, J. Romeu, R. Pous, J. Ramis and A Hijazo, "La Antena de Koch: Un Monopolo Large Pero Pequeno," XIII Simposium Nacional URSI, vol. 1, pp. 371-373, Pamplona, Sep. 1998.
C. Puente, and R. Pous, "Diseno Fractal de Agrupaciones de Antenas," IX Simposium Nacional URSI, vol. 1, pp. 227-231, Las Palmas, Sep. 1994.
C. Puente, J. Romeu, R. Pous and A. Cardama, "Multiband Fractal Antennas and Arrays," Fractals in Engineering, J.L. Vehel, E. Lutton, C. Tricot editors, Springer, New York, pp. 222-236, 1997.
C. Puente and R. Pous, "Fractal Design of Multiband and Low Side-Lobe Arrays," IEEE Transactions on Antennas and Propagation, vol. 44, No. 5, pp. 730-739, May 1996.
Wong, An improved microstrip sierpinski carpet antenna, Proceedings of APM2001, 2001.
Musser, G. Practical Fractals, Scientific American, Jul. 1999, vol. 281, Num. 1.
Hart, Fractal element antennas, [http://www.manukau.ac.nz/departments/e_e/research/ngaire.pdf]., 2007.
Matsushima, Electromagnetically coupled dielectric chip antenna, IEEE Antennas and Propagation Society International Symposium, 1998, vol. 4.
Smith, Efficiency of electrically small antennas combined with matching networks, IEEE Transactions on Antennas and Propagation, May 1997, vol. AP-25, p. 369-373.
Strugatsky, Multimode multiband antenna, Proceedings of the Tactical Communications Conference, 1992. vol. 1.
Pozar, Comparison of three methods for the measurement of printed antenna efficiency, IEEE Transactions on Antennas and Propagation, Jan. 1988, vol. 36.
Yew-Siow, Dipole configurations with strongly improved radiation efficiency for hand-held transceivers, IEEE Transactions on Antennas and Propagation, 1998, vol. 46, Num. 6.
Arutaki, Communication in a three-layered conducting media with a vertical magnetic dipole, IEEE Transactions on Antennas and Propagation, Jul. 1980, vol. AP-28, Num 4.
Desclos, An interdigitated printed antenna for PC card applications, IEEE Transactions on Antennas and Propagation, Sep. 1998, vol. 46, No. 9.
Hikata et al. Miniature SAW antenna duplexer for 800-MHz portable telephone used in cellular radio systems, IEEE Transactions on Microwave Theory and Techniques, Jun. 1988, vol. 36, No. 6.
Ancona, On small antenna impedance in weakly dessipative media, IEEE Transactions on Antennas and Propagation, Mar. 1978, vol. AP-26, No. 2.
Simpson, Equivalent circuits for electrically small antennas using LS-decomposition with the method of moments, IEEE Transactions on Antennas and Propagation, Dec. 1989, vol. 37, No. 12.
Debicki, Calculating input impedance of electrically small insulated antennas for microwave hyperthermia, IEEE Transactions on Microwave Theory and Techniques, Feb. 1993, vol. 41, No. 2.
McLean, A re-examination of the fundamental limits on the radiation Q of electrically small antennas, IEEE Transactions on Antennas and Propagation, May 1996, vol. 44, No. 5.
Muramoto, Characteristics of a small planar loop antenna, IEEE Transactions on Antennas and Propagation, Dec. 1997, vol. 45, No. 12.
Eratuuli, Dual frequency wire antennas, Electronic Letters, Jun. 1996, vol. 32, No. 12.
Ohmine, A TM mode annular-ring microstrip anetenna for personal satellite communication use, IEEE Transactions Communication, Sep. 1996, vol. E-79.
Poilasne, Active Metallic Photonic Band-Gap Materials (MPBG): Experimental Results on Beam Shaper, IEEE Transactions on Antennas and Propagation, Jan. 2000, vol. 48, No. 1.
Omar, A new broad-band, dual-frequency coplanar waveguide fed slot-antenna, IEEE Antennas and Propagation Society International Symposium, 1999. vol. 2.
Hoffmeister, M., The dual frequency inverted f monopole antenna for mobile communications, 1999.

Kutter, R.E., Fractal antenna design, BEE, University of Dayton, Ohio, 1996.
Davidson, B. et al. Wideband helix antenna for PDC diversity, International Congress, Molded Interconnect Devices, Sep. 1998.
Breden, R. et al. Multiband printed antenna for vehicles, 1999.
Werner et al. Radiation characteristics of thin-wire ternary fractal trees, Electronics Letters, 1999, vol. 35, No. 8.
Gobien, Andrew T., "Investigation of Low Profile Antenna Designs for Use in Hand-Held Radios" (Thesis), Aug. 1, 1997, Faculty of the Virginia Polytechnic Institute and State University, Blacksburg, Virginia, U.S.A.
Chu, J.L., Physical limitations of omni-directional antennas, Journal of Applied Physics, Dec. 1948.
Wheeler, Fundamental limitations of small antennas, Proceedings of the I.R.E., 1947.
Addison P. S., Fractals and chaos, Institute of Physics Publishing, 1997.
Falconer, K., Fractal geometry. Mathematical foundations and applications, Wiley, 2003.
Carver, K.R.; Mink, J.W., "Microstrip antenna technology", IEEE Transactions on Antennas and Propagation, Jan. 1981 in Microstrip antennas. The analysis and design of microstrip antennas and arrays, Pozar-Schaubert, 1995.
Chapters: 6) Wheeler, H.A. "Small antennas", 7) Munson, R.E. "Microstrip antennas", 14) Duhamel, R.H.; Scherer, J.P. "Frequency-independent antennas", 23) Offutt, W.B.; Desize, L.K. "Methods of polarization synthesis" in Antenna engineering handbook, McGraw-Hill, 1993.
Kraus, J.D., Antennas, McGraw-Hill, 1988, p. 354-358.
Garg, R.; Bahl, I.J., Characteristics of coupled microstriplines, IEEE Transactions on microwave theory and techniques, Jul. 1979.
Tang, Y.Y. et al, The application of fractal analysis to feature extraction, IEEE, 1999.
Ng, V.; Coldman, A., Diagnosis of melanoma withn fractal dimensions, IEEE Tencon'93, 1993.
Kobayashi, K. et al, Estimation of 3D fractal dimension of real electrical tree patterns, Proceedings of the 4th International Conference on Properties and Applications of Dielectric Materials, Jul. 1994.
Feng. J. et al, Fractional box-counting approach to fractal dimension estimation, IEEE, 1996.
Rouvier, R. et al, Fractal analysis of bidimensional profiles and application to electromagnetic scattering from soils, IEEE, 1996.
Sarkar, N.; Chaudhuri, B.B., An efficient differential box-counting approach to compute fractal dimension of image, IEEE Transactions on System, Man and Cybernetics, Jan. 3, 1994.
Chen, S., et al, On the calculation of Fractal features from images, IEEE Transactions on Pattern Analysis and Machine Intelligence, Oct. 1993.
Penn, A.I., et al, Fractal dimension of low-resolution medical images, 18th annual international conference of the IEEE Engineering in Medicine and Biology Society, 1996.
Berizzi, F.; Dalle-Mese, E., Fractal analysis of the signal scattered from the sea surface, IEEE Transactions on Antennas and Propagation, Feb. 1999.
Boshoff, H.F.V., A fast box counting algorithm for determining the fractal dimension of sampled continuous functions, IEEE, 1992.
Chapters: 1) "Counting and number systems", 3) "Meanders and fractals" and 5) "The analysis of a fractal" in Lauwerier, H., Fractals. Endlessly repeated geometrical figures, Princeton University Press, 1991.
Romeu, J. et al, Small fractal antennas, Fractals in engineering conference, India, Jun. 1999.
Russell, D. A., Dimension of strange attractors, Physical Review Letters, vol. 45, No. 14, Oct. 1980.
So, P. et al, Box-counting dimension without boxes—Computing D0 from average expansion, Physical Review E, vol. 60, No. 1, Jul. 1999.
Prokhorov, A.M., Bolshaya Sovetskaya Entsiklopediya, Sovetskaya Entsiklopediya, 1976, vol. 24, Book 1, p. 67.
Model, A.M., Microwave filters in radio relay systems, Moscow, Svyaz, 1967, p. 108-109.
Pozar, D.M., Microstrip antennas, Proceedings of the IEEE, 1992.
G. James, J.R.; Hall, P.S., Handbook of microstrip antennas, IEE, 1989, vol. 1, p. 355-357.
Navarro, M., Diverse modifications applied to the Sierpinski antenna, a multi-band fractal antenna (final degree project), Universitat Politècnica de Catalunya, Oct. 1997.
Neary, D., Fractal methods in image analysis and coding, Dublin City University—School of Electronic Engineering, Jan. 22, 2001.
Breden , R. et al, Printed fractal antennas, National conference on antennas and propagation, Apr. 1999.
Cohen , N. et al, Fractal loops and the small loop approximation—Exploring fractal resonances, Communications quarterly, Dec. 1996.

* cited by examiner

SPACE-FILLING MINIATURE ANTENNAS

CROSS REFERENCE TO RELATED APPLICATIONS

This application is a Divisional Application of U.S. patent application Ser. No. 11/179,250, filed on Jul. 12, 2005, now U.S. Pat. No. 7,202,822, entitled SPACE-FILLING MINIATURE ANTENNAS, which is a Continuation Application of application Ser. No. 11/110,052 filed Apr. 20, 2005 now U.S. Pat. No. 7,148,850, issued on Dec. 12, 2006, entitled: SPACE-FILLING MINIATURE ANTENNAS, which is a Continuation Application of U.S. patent application Ser. No. 10/182,635, filed on Nov. 1, 2002, now abandoned, entitled: SPACE-FILLING MINIATURE ANTENNAS, which is a 371 of PCT/EP00/00411, filed on Jan. 19, 2000, entitled: SPACE-FILLING MINIATURE ANTENNAS.

OBJECT OF THE INVENTION

The present invention generally refers to a new family of antennas of reduced size based on an innovative geometry, the geometry of the curves named as Space-Filling Curves (SFC). An antenna is said to be a small antenna (a miniature antenna) when it can be fitted in a small space compared to the operating wavelength. More precisely, the radiansphere is taken as the reference for classifying an antenna as being small. The radiansphere is an imaginary sphere of radius equal to the operating wavelength divided by two times $\pi$; an antenna is said to be small in terms of the wavelength when it can be fitted inside said radiansphere.

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

The invention is applicable to the field of the telecommunications and more concretely to the design of antennas with reduced size.

BACKGROUND AND SUMMARY OF THE INVENTION

The fundamental limits on small antennas where theoretically established by H-Wheeler and L. J. Chu in the middle 1940's. They basically stated that a small antenna has a high quality factor (Q) because of the large reactive energy stored in the antenna vicinity compared to the radiated power. Such a high quality factor yields a narrow bandwidth; in fact, the fundamental derived in such theory imposes a maximum bandwidth given a specific size of an small antenna.

Related to this phenomenon, it is also known that a small antenna features a large input reactance (either capacitive or inductive) that usually has to be compensated with an external matching/loading circuit or structure. It also means that is difficult to pack a resonant antenna into a space which is small in terms of the wavelength at resonance. Other characteristics of a small antenna are its small radiating resistance and its low efficiency.

Searching for structures that can efficiently radiate from a small space has an enormous commercial interest, especially in the environment of mobile communication devices (cellular telephony, cellular pagers, portable computers and data handlers, to name a few examples), where the size and weight of the portable equipments need to be small. According to R. C. Hansen (R. C. Hansen, "Fundamental Limitations on Antennas," Proc. IEEE, vol. 69, no. 2, February 1981), the performance of a small antenna depends on its ability to efficiently use the small available space inside the imaginary radiansphere surrounding the antenna.

In the present invention, a novel set of geometries named Space-Filling Curves (hereafter SFC) are introduced for the design and construction of small antennas that improve the performance of other classical antennas described in the prior art (such as linear monopoles, dipoles and circular or rectangular loops).

Some of the geometries described in the present invention are inspired in the geometries studied already in the XIX century by several mathematicians such as Giusepe Peano and David Hilbert. In all said cases the curves were studied from the mathematical point of view but were never used for any practical-engineering application.

The dimension (D) is often used to characterize highly complex geometrical curves and structures such those described in the present invention. There exists many different mathematical definitions of dimension but in the present document the box-counting dimension (which is well-known to those skilled in mathematics theory) is used to characterize a family of designs. Those skilled in mathematics theory will notice that optionally, an Iterated Function System (IFS), a Multireduction Copy Machine (MRCM) or a Networked Multireduction Copy Machine (MRCM) algorithm can be used to construct some space-filling curves as those described in the present invention.

The key point of the present invention is shaping part of the antenna (for example at least a part of the arms of a dipole, at least a part of the arm of a monopole, the perimeter of the patch of a patch antenna, the slot in a slot antenna, the loop perimeter in a loop antenna, the horn cross-section in a horn antenna, or the reflector perimeter in a reflector antenna) as a space-filling curve, that is, a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the structure of a miniature antenna according to the present invention, the segments of the SFC curves must be shorter than a tenth of the free-space operating wavelength.

Depending on the shaping procedure and curve geometry, some infinite length SFC can be theoretically designed to feature a Haussdorf dimension larger than their topological-dimension. That is, in terms of the classical Euclidean geometry, It is usually understood that a curve is always a one-dimension object; however when the curve is highly convoluted and its physical length is very large, the curve tends to fill parts of the surface which supports it; in that case the Haussdorf dimension can be computed over the curve (or at least an approximation of it by means of the box-counting algorithm) resulting in a number larger than unity. Such theoretical infinite curves can not be physically constructed, but they can be approached with SFC designs. The curves 8 and 17 described in and FIG. 2 and FIG. 5 are some examples of such SFC, that approach an ideal infinite curve featuring a dimension D=2.

The advantage of using SFC curves in the physical shaping of the antenna is two-fold:

(a) Given a particular operating frequency or wavelength said SFC antenna can be reduced in size with respect to prior art.

(b) Given the physical size of the SFC antenna, said SFC antenna can be operated at a lower frequency (a longer wavelength) than prior art.

DETAILED DESCRIPTION OF THE PREFERRED EMBODIMENTS

Figure 1:
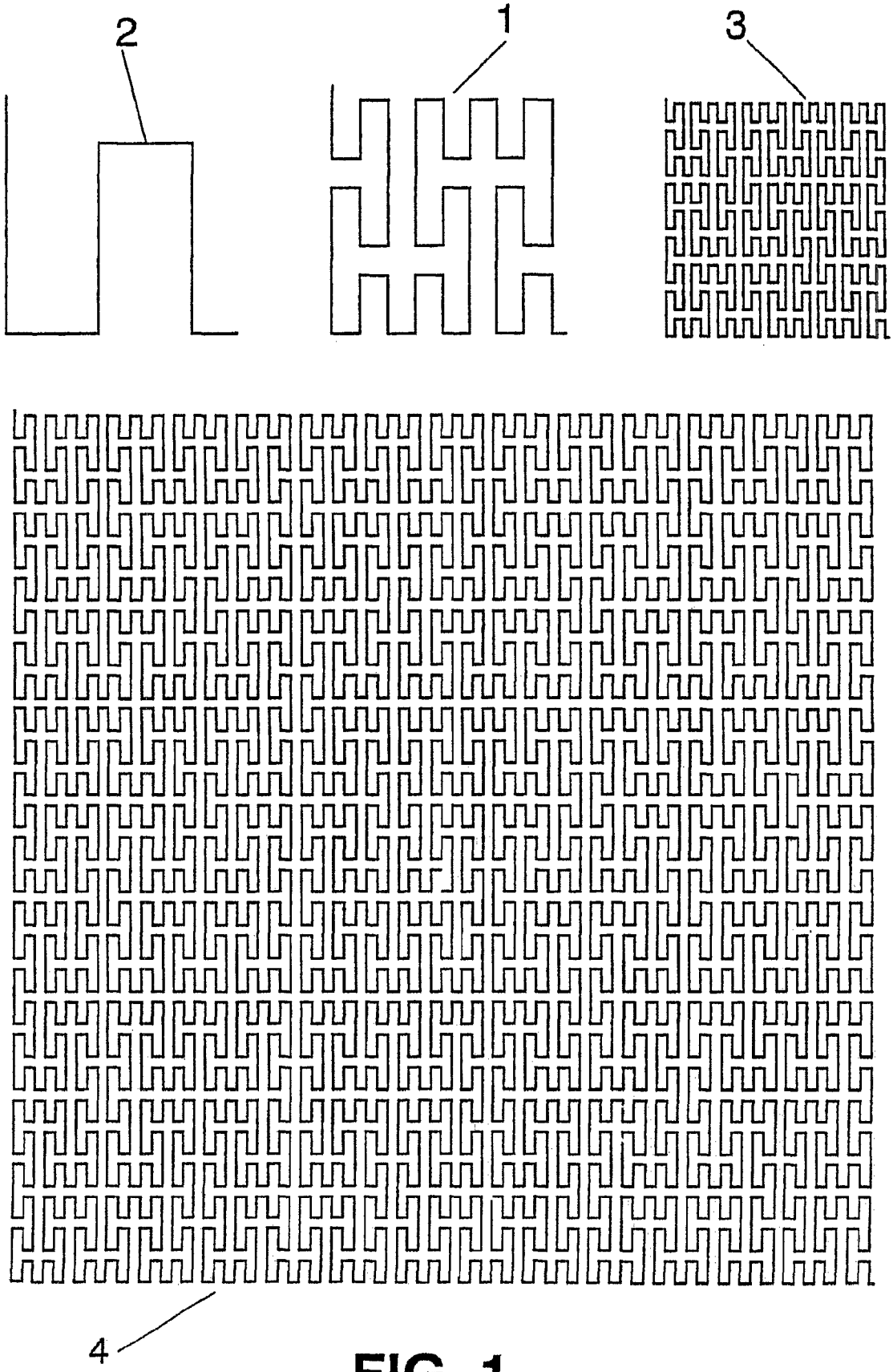
FIG. 1 shows some particular cases of SFC curves. From an initial curve (2), other curves (1), (3) and (4) with more than 10 connected segments are formed. This particular family of curves are named hereafter SZ curves.
Figure 2:
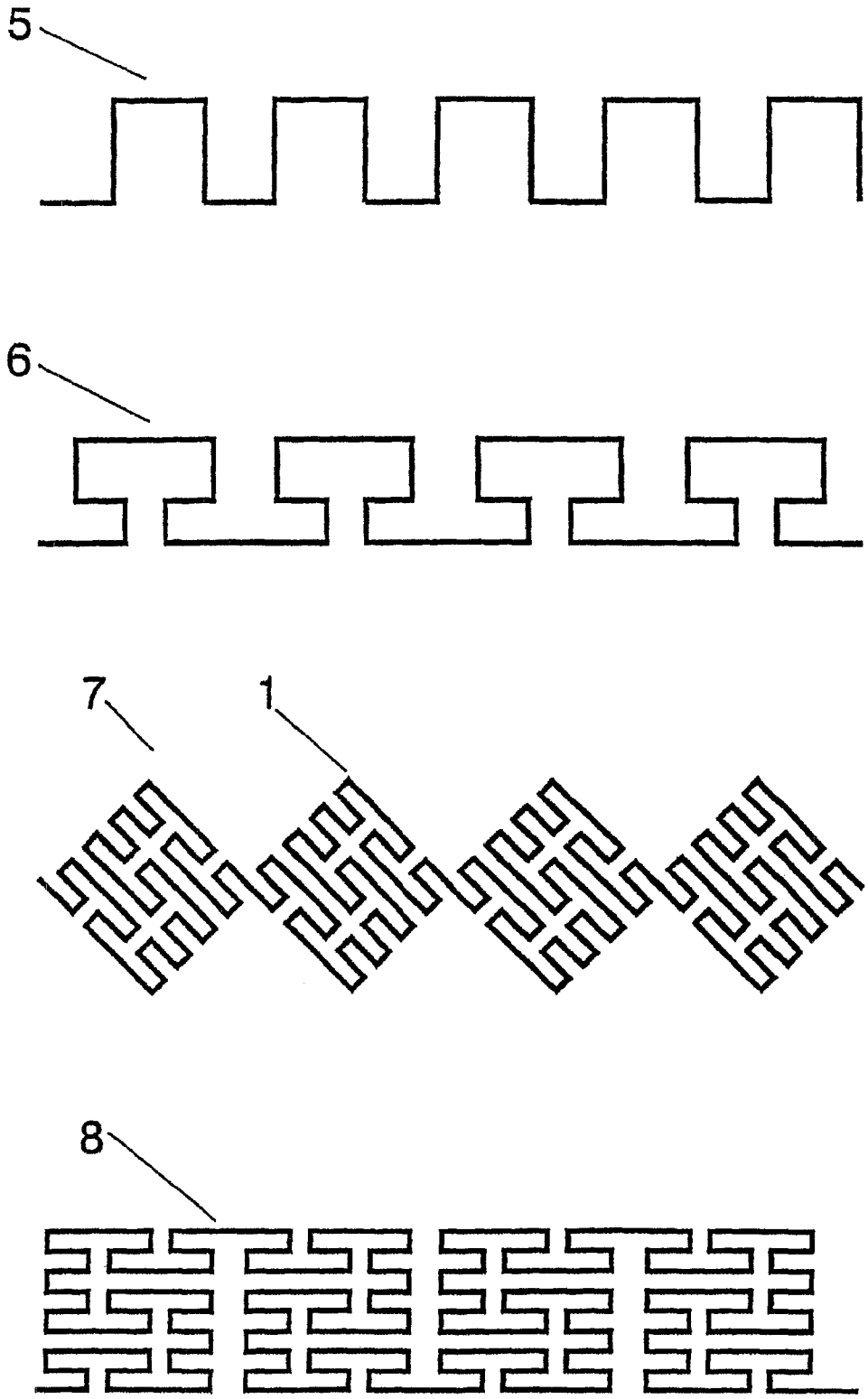
FIG. 2 shows a comparison between two prior art meandering lines and two SFC periodic curves, constructed from the SZ curve of drawing 1.

FIG. 1 and FIG. 2 show some examples of SFC curves. Drawings (1), (3) and (4) in FIG. 1 show three examples of SFC curves named SZ curves. A curve that is not an SFC since it is only composed of 6 segments is shown in drawing (2) for comparison. The drawings (7) and (8) in FIG. 2 show another two particular examples of SFC curves, formed from the periodic repetition of a motive including the SFC curve (1). It is important noticing the substantial difference between these examples of SFC curves and some examples of periodic, meandering and not SFC curves such as those in drawings (5) and (6) in FIG. 2. Although curves (5) and (6) are composed by more than 10 segments, they can be substantially considered periodic along a straight direction (horizontal direction) and the motive that defines a period or repetition cell is constructed with less than 10 segments (the period in drawing (5) includes only four segments, while the period of the curve (6) comprises nine segments) which contradicts the definition of SFC curve introduced in the present invention. SFC curves are substantially more complex and pack a longer length in a smaller space; this fact in conjunction with the fact that each segment composing and SFC curve is electrically short (shorter than a tenth of the free-space operating wavelength as claimed in this invention) play a key role in reducing the antenna size. Also, the class of folding mechanisms used to obtain the particular SFC curves described in the present invention are important in the design of miniature antennas.

Figure 3:
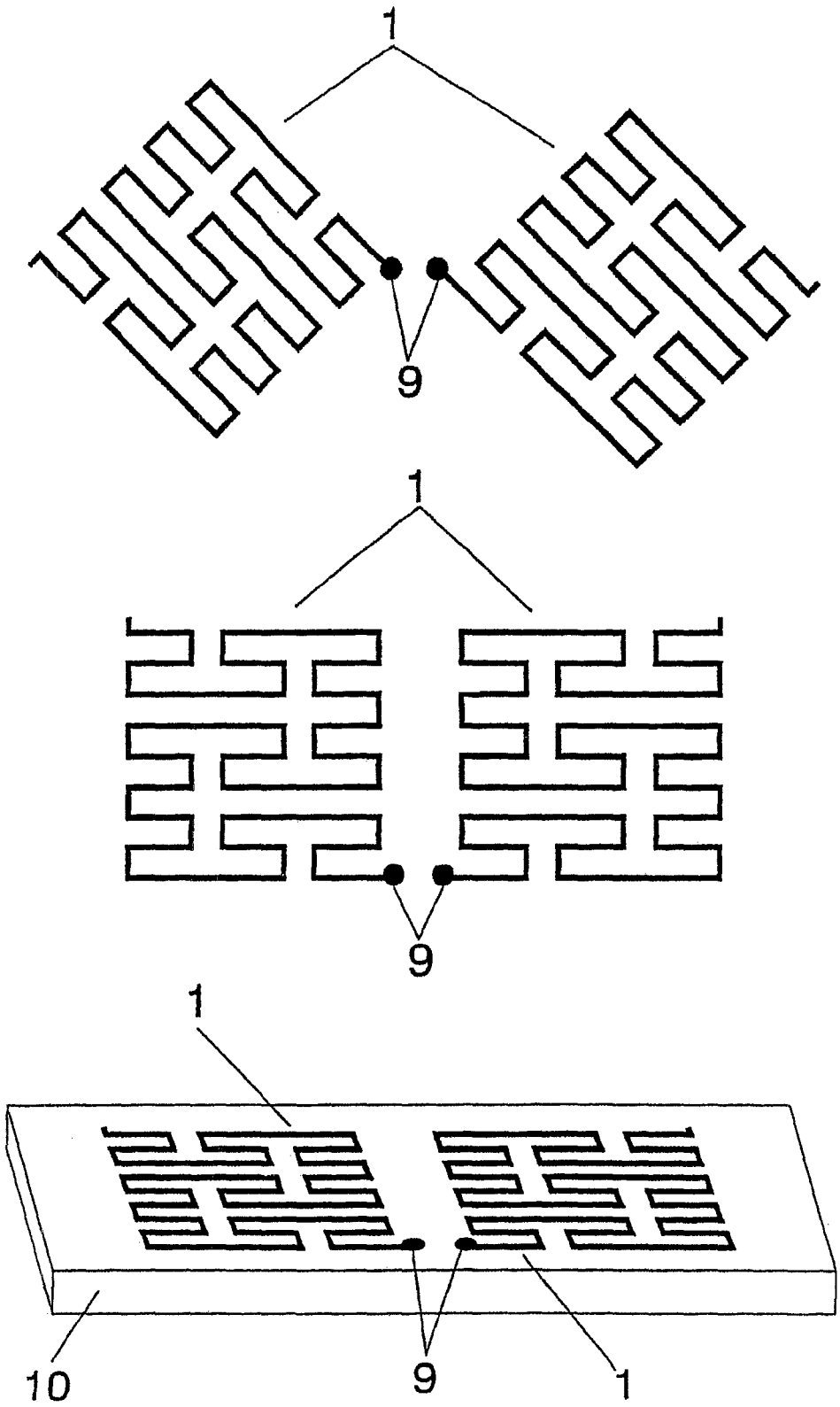
FIG. 3 shows a particular configuration of an SFC antenna. It consists on tree different configurations of a dipole wherein each of the two arms is fully shaped as an SFC curve (1).

FIG. 3 describes a preferred embodiment of an SFC antenna. The three drawings display different configurations of the same basic dipole. A two-arm antenna dipole is constructed comprising two conducting or superconducting parts, each part shaped as an SFC curve. For the sake of clarity but without loss of generality, a particular case of SFC curve (the SZ curve (1) of FIG. 1) has been chosen here; other SFC curves as for instance, those described in FIG. 1, 2, 6, 8, 14, 19, 20, 21, 22, 23, 24 or 25 could be used instead. The two closest tips of the two arms form the input terminals (9) of the dipole. The terminals (9) have been drawn as conducting or superconducting circles, but as it is clear to those skilled in the art, such terminals could be shaped following any other pattern as long as they are kept small in terms of the operating wavelength. Also, the arms of the dipoles can be rotated and folded in different ways to finely modify the input impedance or the radiation properties of the antenna such as, for instance, polarization. Another preferred embodiment of an SFC dipole is also shown in FIG. 3, where the conducting or superconducting SFC arms are printed over a dielectric substrate (10); this method is particularly convenient in terms of cost and mechanical robustness when the SFC curve is long. Any of the well-known printed circuit fabrication techniques can be applied to pattern the SFC curve over the dielectric substrate. Said dielectric substrate can be for instance a glass-fibre board, a teflon based substrate (such as Cuclad®) or other standard radiofrequency and microwave substrates (as for instance Rogers 4003® or Kapton®). The dielectric substrate can even be a portion of a window glass if the antenna is to be mounted in a motor vehicle such as a car, a train or an air-plane, to transmit or receive radio, TV, cellular telephone (GSM 900, GSM 1800, UMTS) or other communication services electromagnetic waves. Of course, a balun network can be connected or integrated at the input terminals of the dipole to balance the current distribution among the two dipole arms.

Figure 4:
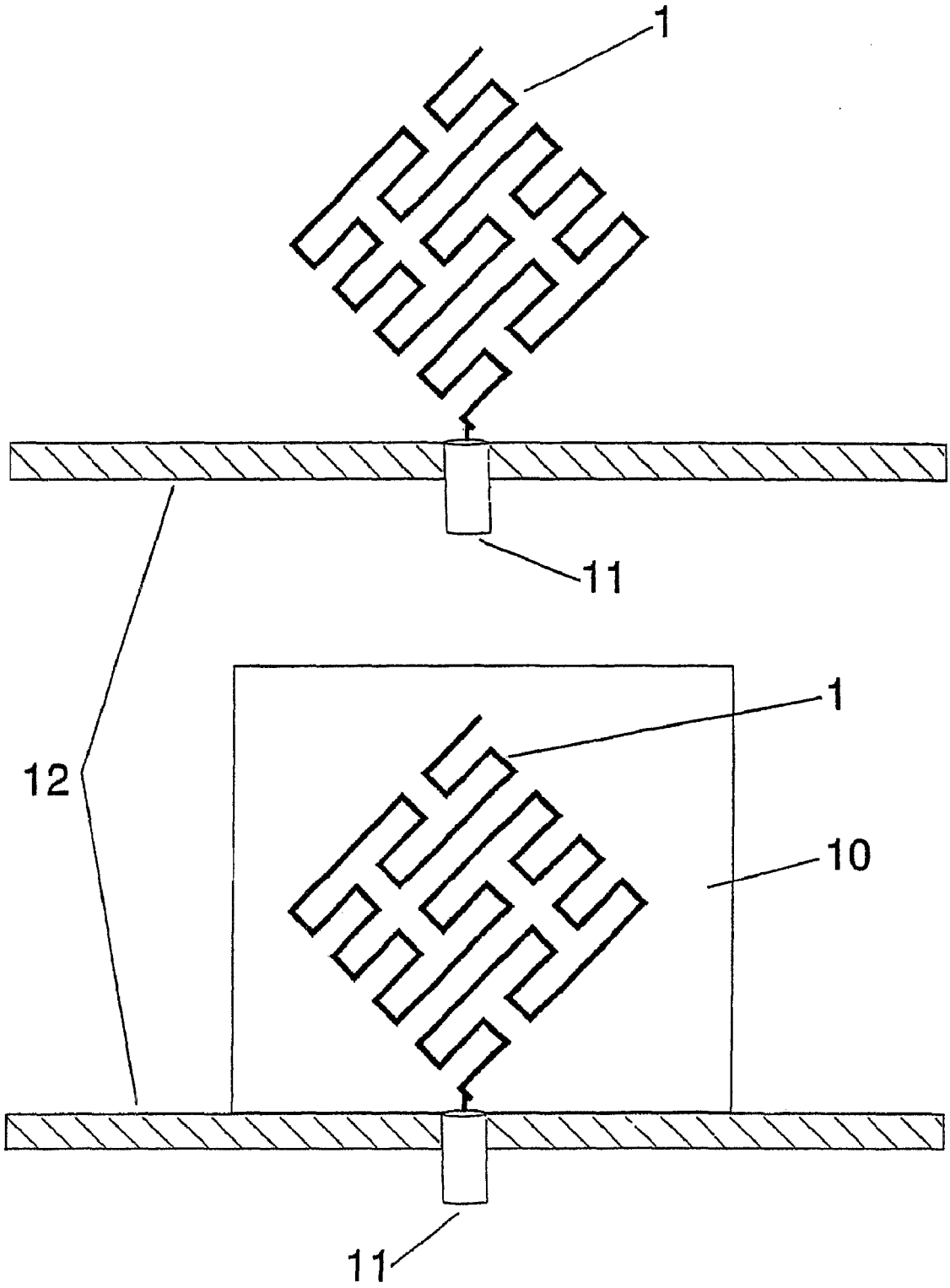
FIG. 4 shows other particular cases of SFC antennas. They consist on monopole antennas.

Another preferred embodiment of an SFC antenna is a monopole configuration as shown in FIG. 4. In this case one of the dipole arms is substituted by a conducting or superconducting counterpoise or ground plane (12). A handheld telephone case, or even a part of the metallic structure of a car, train or can act as such a ground counterpoise. The ground and the monopole arm (here the arm is represented with SFC curve (1), but any other SFC curve could be taken instead) are excited as usual in prior art monopoles by means of, for instance, a transmission line (11). Said transmission line is formed by two conductors, one of the conductors is connected to the ground counterpoise while the other is connected to a point of the SFC conducting or superconducting structure. In the drawings of FIG. 4, a coaxial cable (11) has been taken as a particular case of transmission line, but it is clear to any skilled in the art that other transmission lines (such as for instance a microstrip arm) could be used to excite the monopole. Optionally, and following the scheme described in FIG. 3, the SFC curve can be printed over a dielectric substrate (10).

Figure 5:
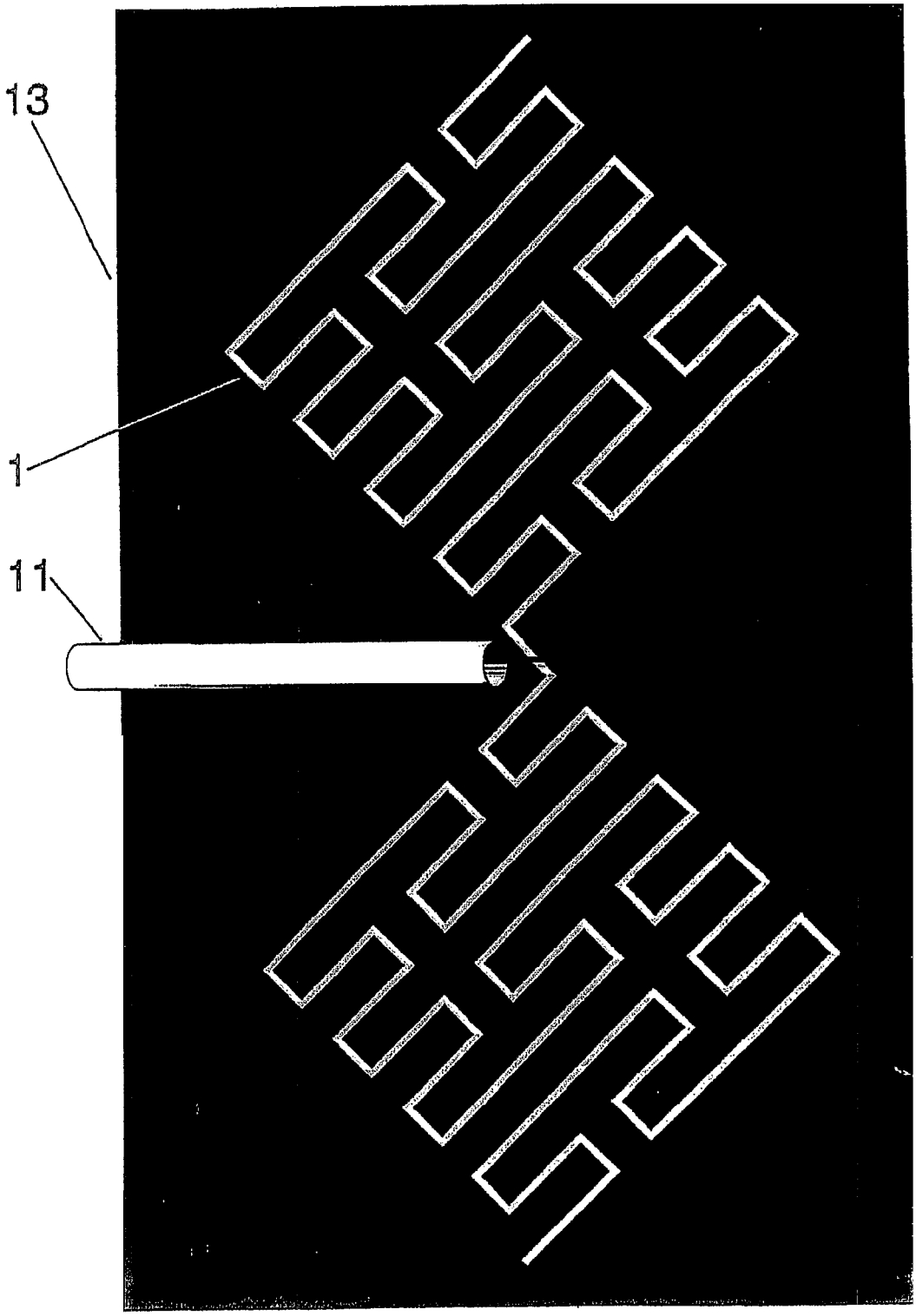
FIG. 5 shows an example of an SFC slot antenna where the slot is shaped as the SFC in drawing 1.
Figure 6:
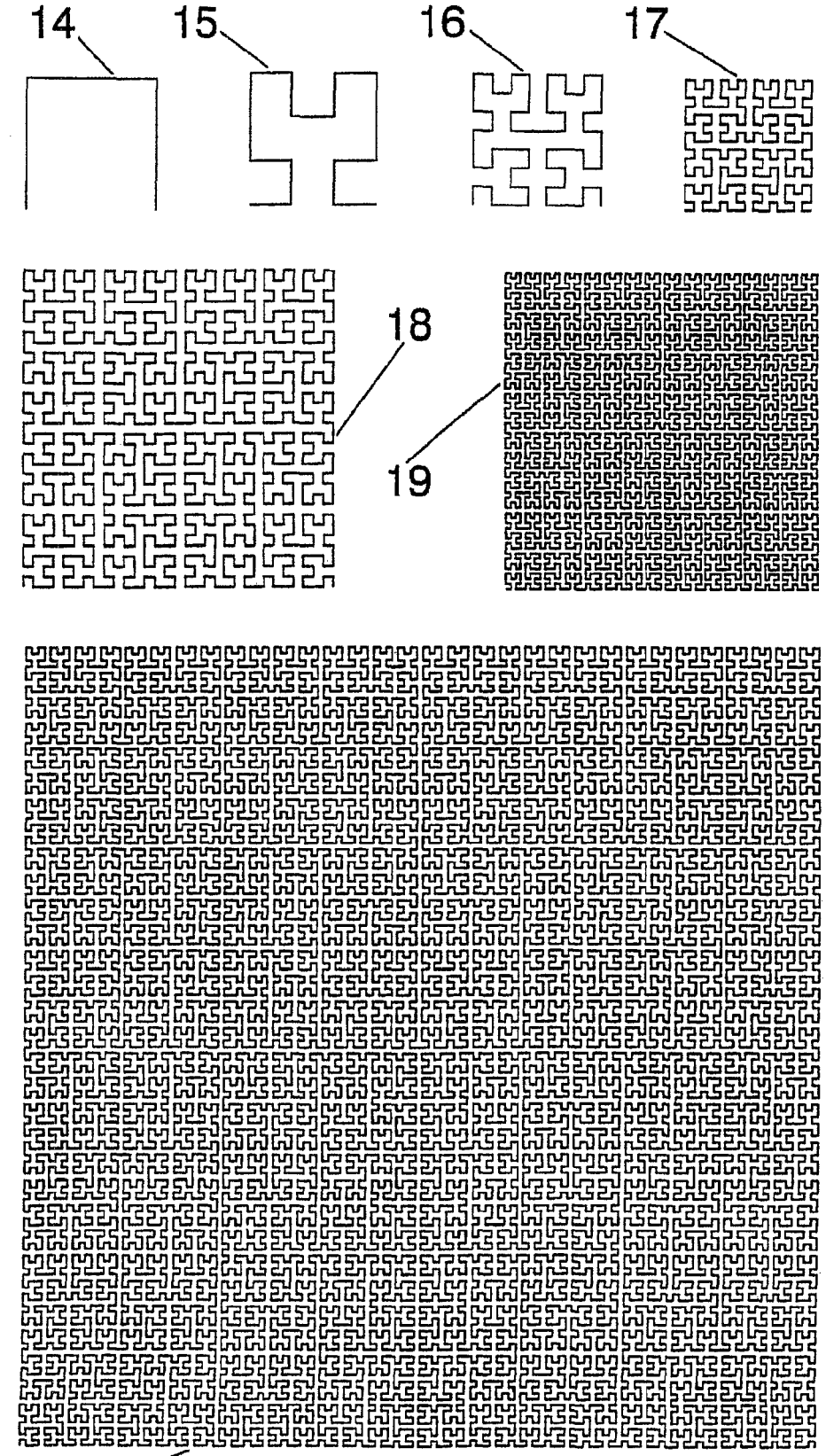
FIG. 6 shows another set of SFC curves (15-20) inspired on the Hilbert curve and hereafter named as Hilbert curves. A standard, non-SFC curve is shown in (14) for comparison.
Figure 7:
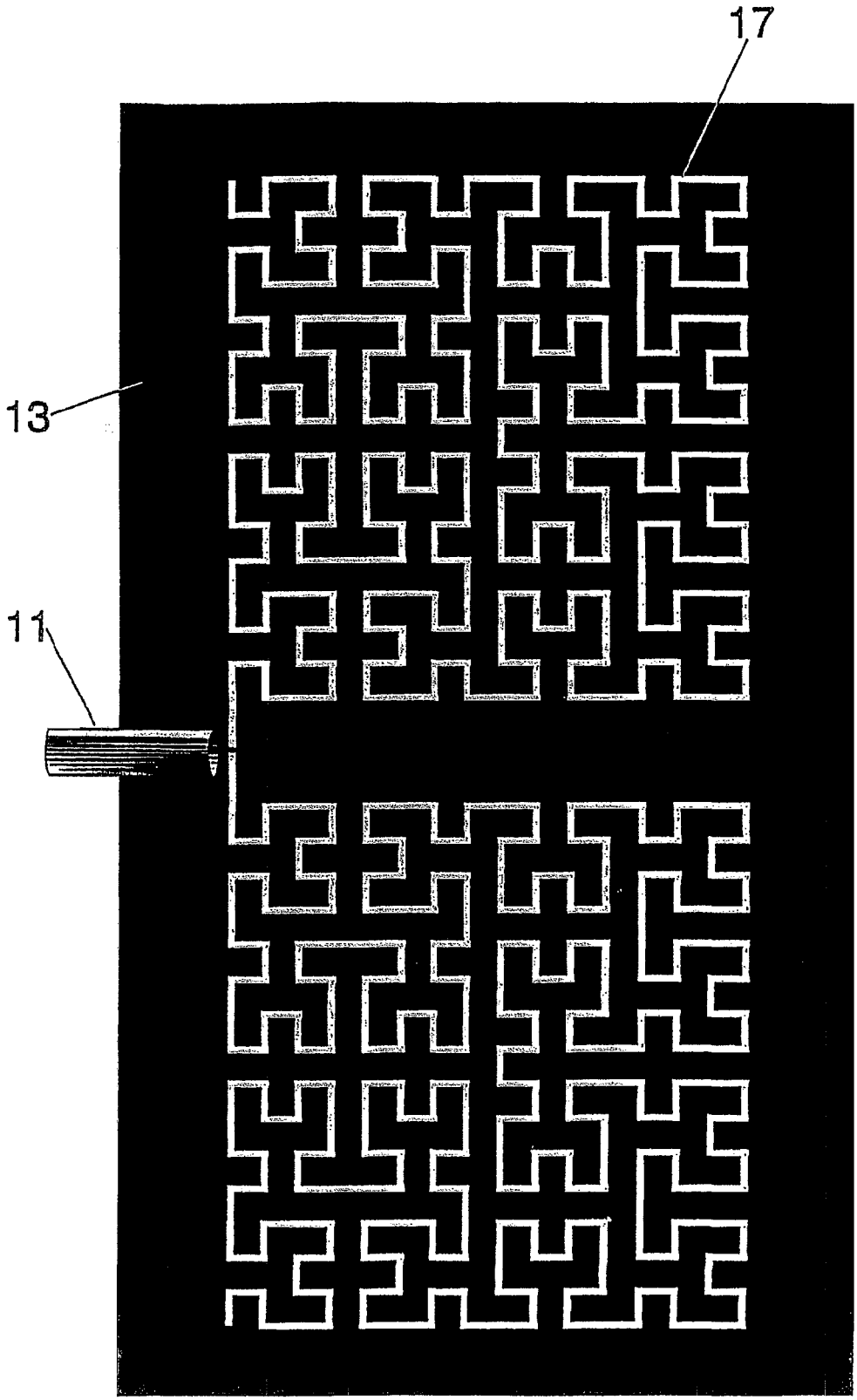
FIG. 7 shows another example of an SFC slot antenna based on the SFC curve (17) in drawing 6.
Figure 8:
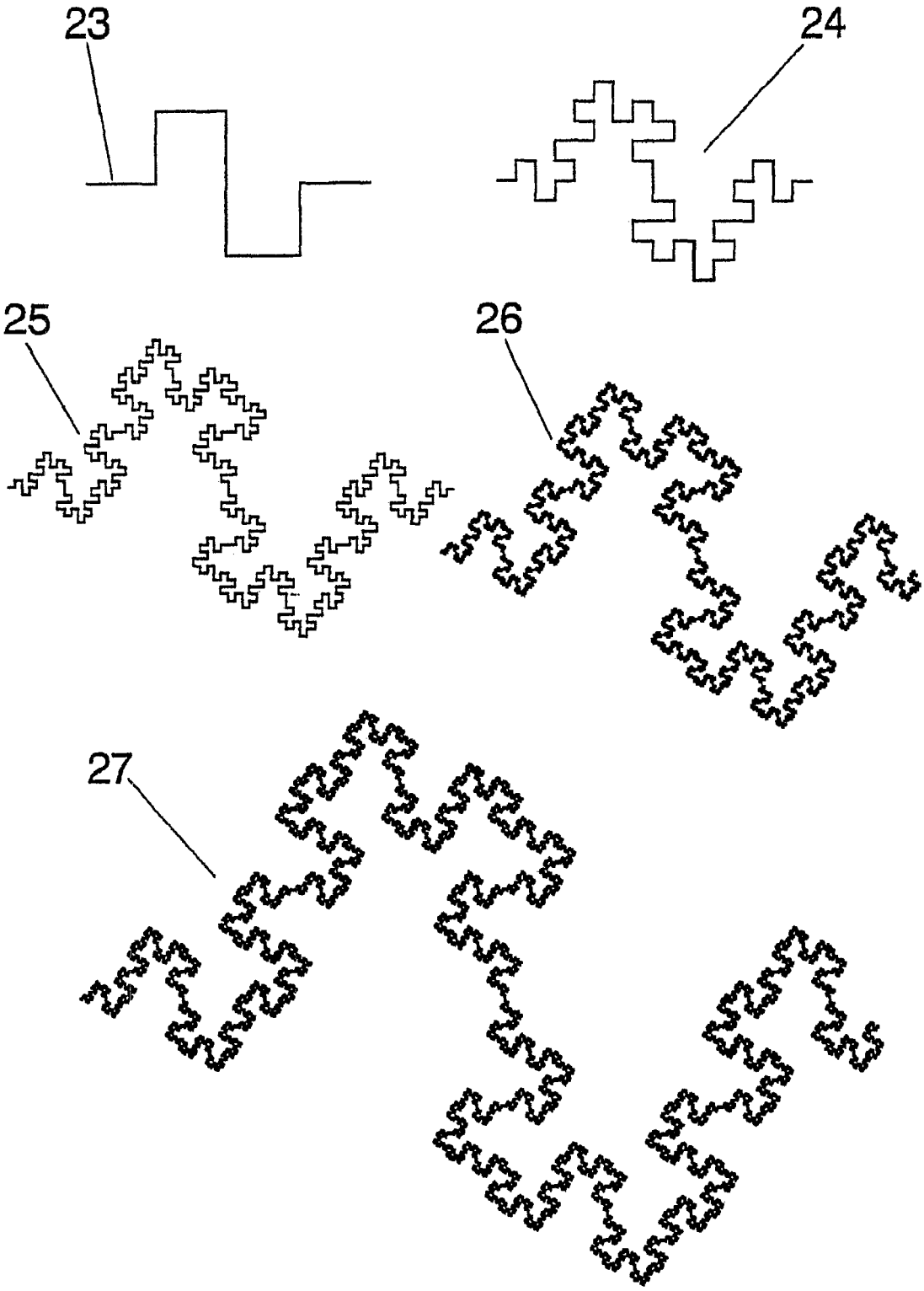
FIG. 8 shows another set of SFC curves (24, 25, 26, 27) hereafter known as ZZ curves. A conventional squared zigzag curve (23) is shown for comparison.
Figure 10:
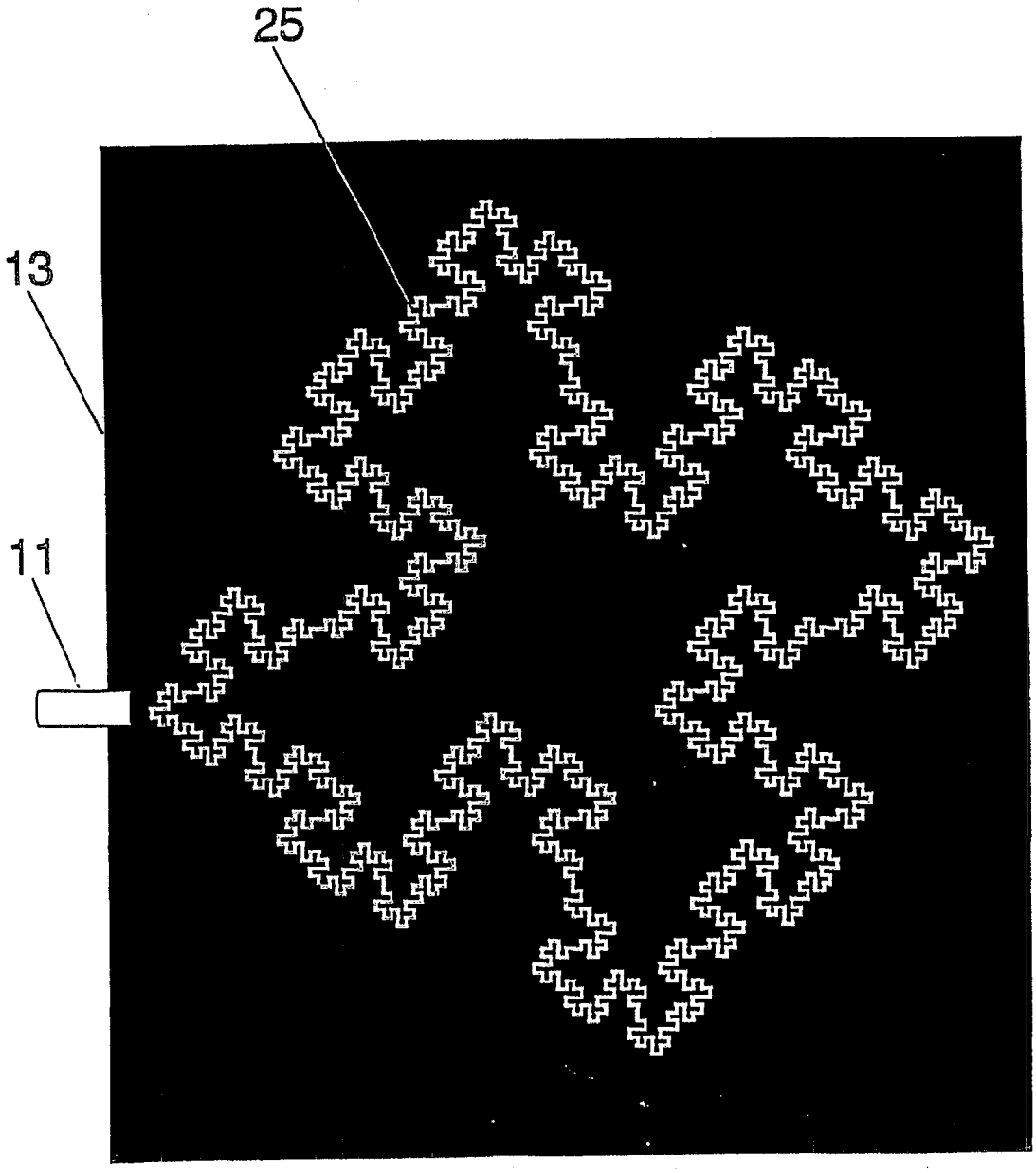
FIG. 10 shows a slot loop antenna based on the SFC (25) in drawing 8.

Another preferred embodiment of an SFC antenna is a slot antenna as shown, for instance in FIGS. 5, 7 and 10. In FIG. 5, two connected SFC curves (following the pattern (1) of FIG. 1) form an slot or gap impressed over a conducting or superconducting sheet (13). Such sheet can be, for instance, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or airplane. The exciting scheme can be any of the well known in conventional slot antennas and it does not become an essential part of the present invention. In all said three figures, a coaxial cable (11) has been used to excite the antenna, with one of the conductors connected to one side of the conducting sheet and the other one connected at the other side of the sheet across the slot. A microstrip transmission line could be used, for instance, instead of the coaxial cable.

To illustrate that several modifications of the antenna that can be done based on the same principle and spirit of the present invention, a similar example is shown in FIG. 7, where another curve (the curve (17) from the Hilbert family) is taken instead. Notice that neither in FIG. 5, nor in FIG. 7 the slot reaches the borders of the conducting sheet, but in another embodiment the slot can be also designed to reach the boundary of said sheet, breaking said sheet in two separate conducting sheets.

FIG. 10 describes another possible embodiment of an slot SFC antenna. It is also an slot antenna in a closed loop configuration. The loop is constructed for instance by connecting four SFC gaps following the pattern of SFC (25) in FIG. 8 (it is clear that other SFC curves could be used instead according to the spirit and scope of the present invention). The resulting closed loop determines the boundary of a conducting or superconducting island surrounded by a conducting or superconducting sheet. The slot can be excited by means of any of the well-known conventional techniques; for instance a coaxial cable (11) can be used, connecting one of the outside conductor to the conducting outer sheet and the inner conductor to the inside conducting island surrounded by the SFC gap. Again, such sheet can be, for example, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or air-plane. The slot can be even formed by the gap between two close but not co-planar conducting island and conducting sheet; this can be physically implemented for instance by mounting the inner conducting island over a surface of the optional dielectric substrate, and the surrounding conductor over the opposite surface of said substrate.

Figure 9:
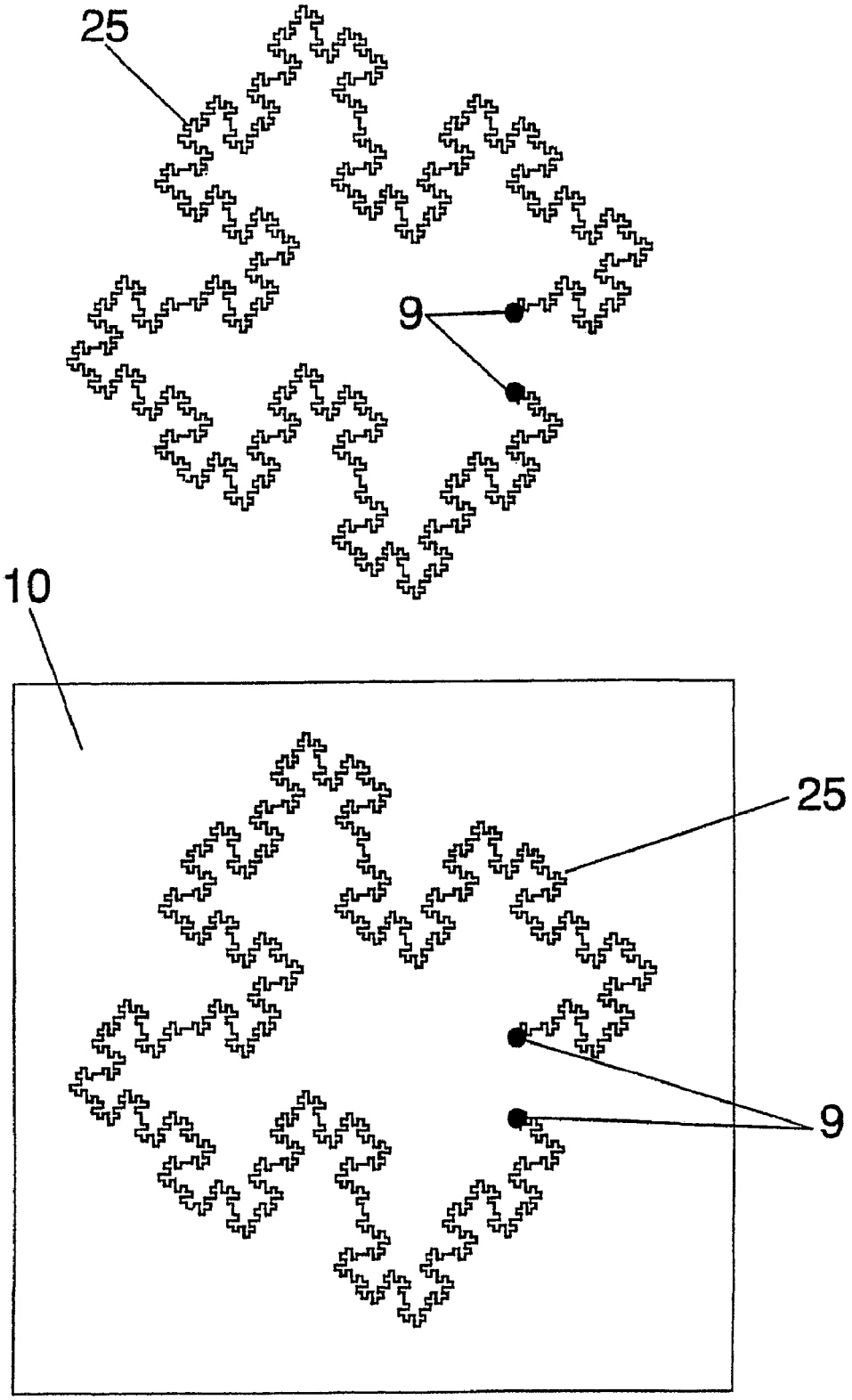
FIG. 9 shows a loop antenna based on curve (25) in a wire configuration (top). Below, the loop antenna 29 is printed over a dielectric substrate (10).

The slot configuration is not, of course, the only way of implementing an SFC loop antenna. A closed SFC curve made of a superconducting or conducting material can be used to implement a wire SFC loop antenna as shown in another preferred embodiment as that of FIG. 9. In this case, a portion of the curve is broken such as the two resulting ends of the curve form the input terminals (9) of the loop. Optionally, the loop can be printed also over a dielectric substrate (10). In case a dielectric substrate is used, a dielectric antenna can be also constructed by etching a dielectric SFC pattern over said substrate, being the dielectric permitivity of said dielectric pattern higher than that of said substrate.

Figure 11:
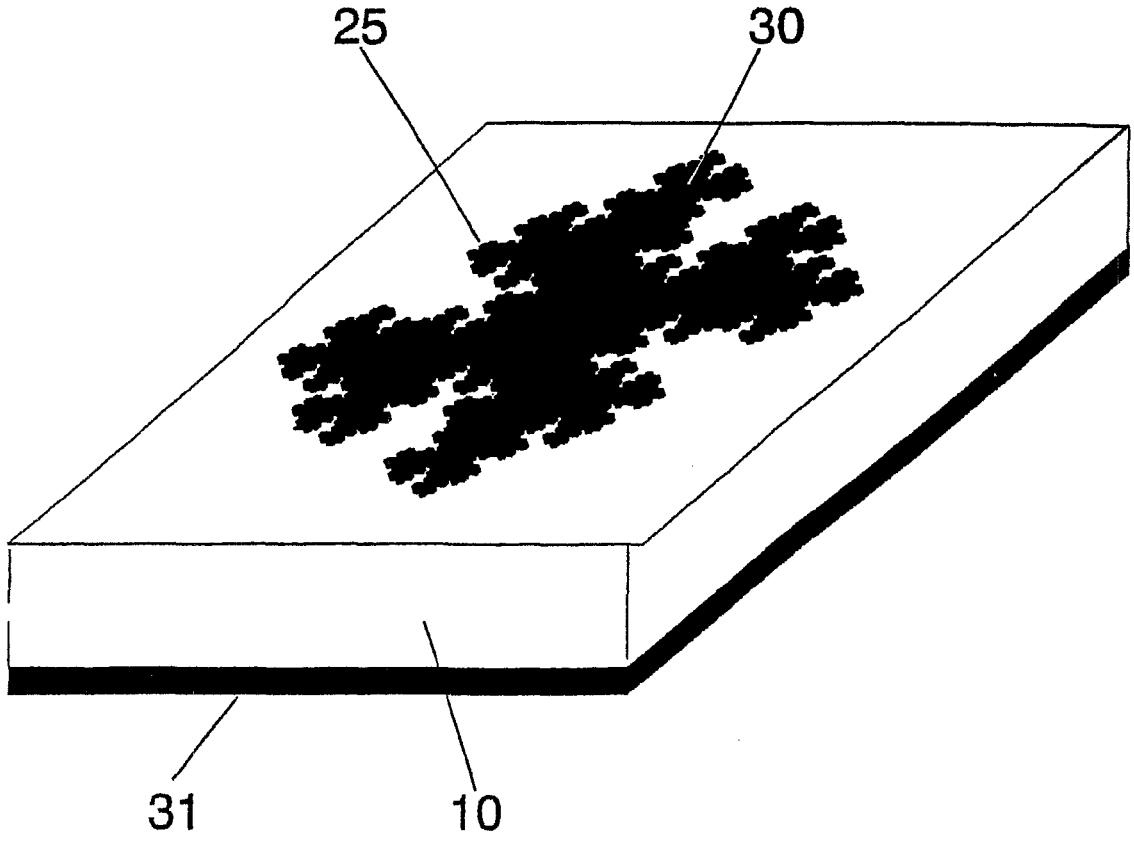
FIG. 11 shows a patch antenna wherein the patch perimeter is shaped according to SFC (25).

Another preferred embodiment is described in FIG. 11. It consists on a patch antenna, with the conducting or superconducting patch (30) featuring an SFC perimeter (the particular case of SFC (25) has been used here but it is clear that other SFC curves could be used instead). The perimeter of the patch is the essential part of the invention here, being the rest of the antenna conformed, for example, as other conventional patch antennas: the patch antenna comprises a conducting or superconducting ground-plane (31) or ground counterpoise, an the conducting or superconducting patch which is parallel to said ground-plane or ground-counterpoise. The spacing between the patch and the ground is typically below (but not restricted to) a quarter wavelength. Optionally, a low-loss dielectric substrate (10) (such as glass-fibre, a teflon substrate such as Cuclad® or other commercial materials such as Rogers® 4003) can be place between said patch and ground counterpoise. The antenna feeding scheme can be taken to be any of the well-known schemes used in prior art patch antennas, for instance: a coaxial cable with the outer conductor connected to the ground-plane and the inner conductor connected to the patch at the desired input resistance point (of course the typical modifications including a capacitive gap on the patch around the coaxial connecting point or a capacitive plate connected to the inner conductor of the coaxial placed at a distance parallel to the patch, and so on can be used as well); a microstrip transmission line sharing the same ground-plane as the antenna with the strip capacitively coupled to the patch and located at a distance below the patch, or in another embodiment with the strip placed below the ground-plane and coupled to the patch through an slot, and even a microstrip transmission line with the strip co-planar to the patch. All these mechanisms are well known from prior art and do not constitute an essential part of the present invention. The essential part of the present invention is the shape of the antenna (in this case the SFC perimeter of the patch) which contributes to reducing the antenna size with respect to prior art configurations.

Figure 13:
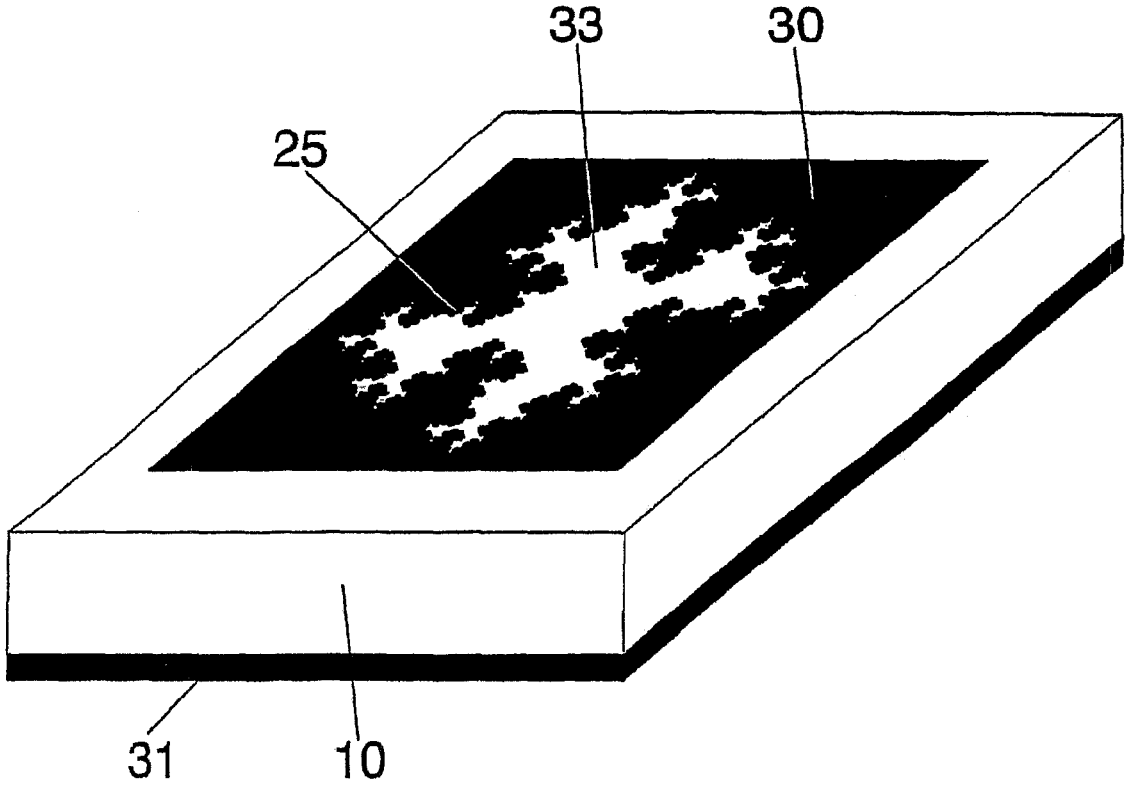
FIG. 13 shows a patch antenna with an aperture on the patch based on SFC (25).
Figure 14:
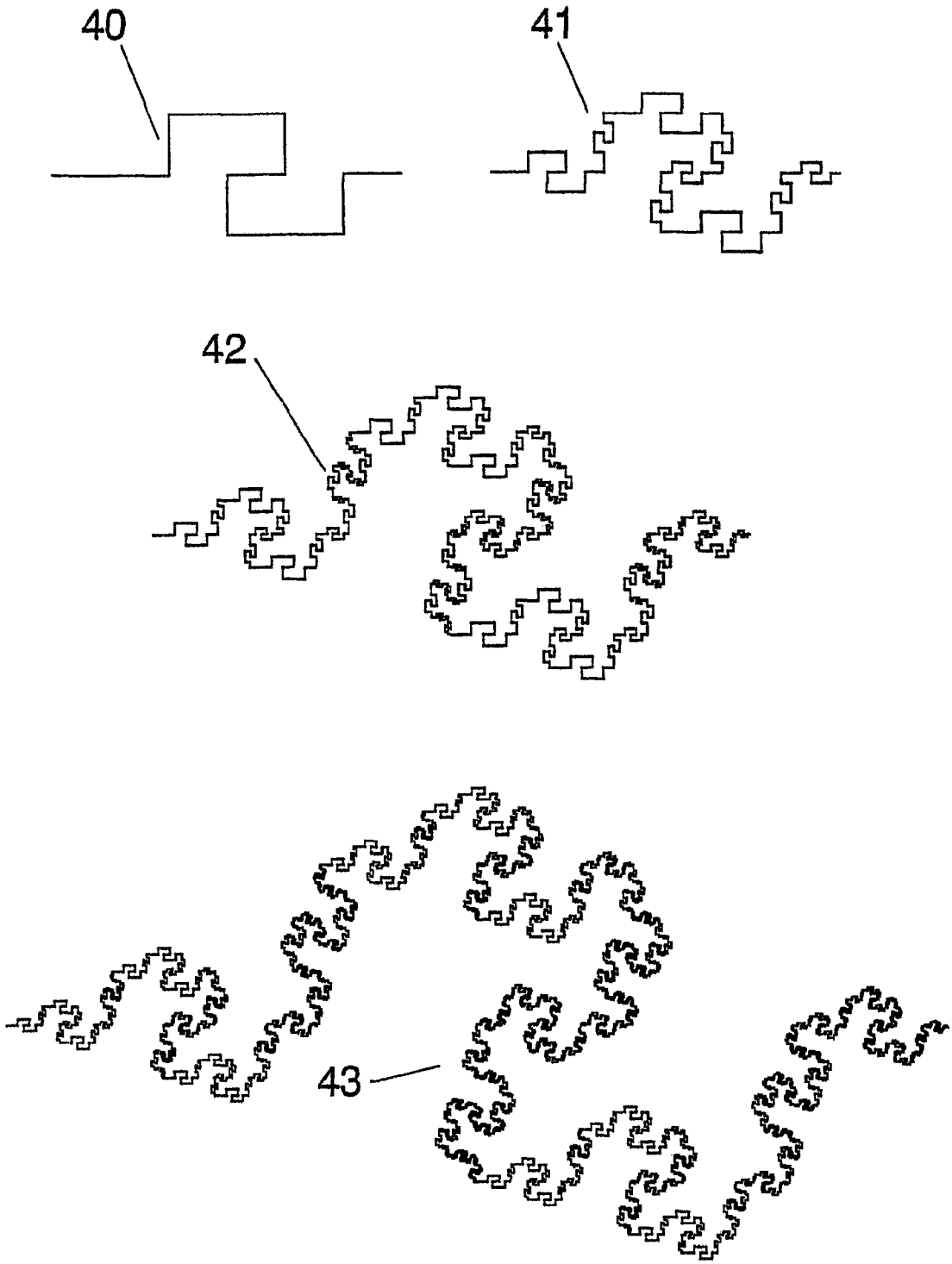
FIG. 14 shows another particular example of a family of SFC curves (41, 42, 43) based on the Giusepe Peano curve. A non-SFC curve formed with only 9 segments is shown for comparison.
Figure 15:
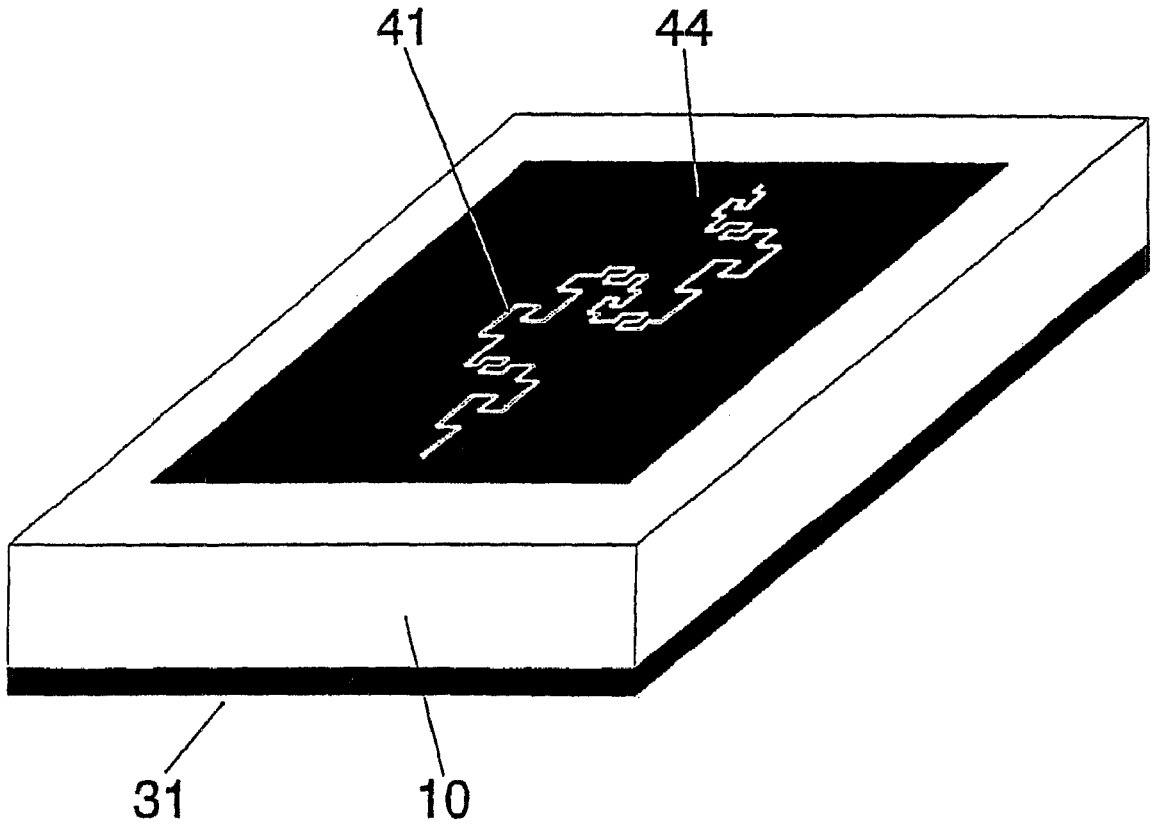
FIG. 15 shows a patch antenna with an SFC slot based on SFC (41).

Other preferred embodiments of SFC antennas based also on the patch configuration are disclosed in FIG. 13 and FIG. 15. They consist on a conventional patch antenna with a polygonal patch (30) (squared, triangular, pentagonal, hexagonal, rectangular, or even circular, to name just a few examples), with an SFC curve shaping a gap on the patch. Such an SFC line can form an slot or spur-line (44) over the patch (as seen in FIG. 15) contributing this way in reducing the antenna size and introducing new resonant frequencies for a multiband operation, or in another preferred embodiment the SFC curve (such as (25) defines the perimeter of an aperture (33) on the patch (30) (FIG. 13). Such an aperture contributes significantly to reduce the first resonant frequency of the patch with respect to the solid patch case, which significantly contributes to reducing the antenna size. Said two configurations, the SFC slot and the SFC aperture cases can of course be use also with SFC perimeter patch antennas as for instance the one (30) described in FIG. 11.

At this point it becomes clear to those skilled in the art what is the scope and spirit of the present invention and that the same SFC geometric principle can be applied in an innovative way to all the well known, prior art configurations. More examples are given in FIGS. 12, 16, 17 and 18.

Figure 12:
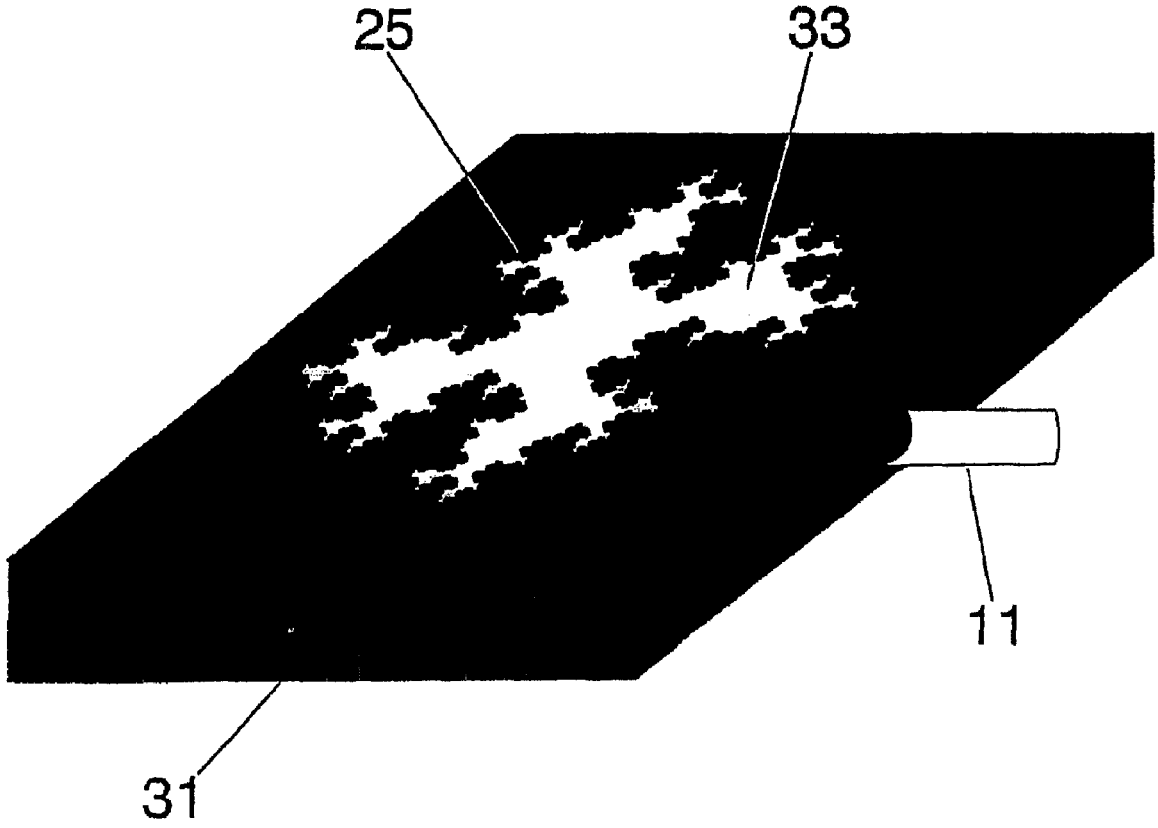
FIG. 12 shows an aperture antenna wherein the aperture (33) is practiced on a conducting or superconducting structure (31), said aperture being shaped with SFC (25).

FIG. 12 describes another preferred embodiment of an SFC antenna. It consists on an aperture antenna, said aperture being characterized by its SFC perimeter, said aperture being impressed over a conducting ground-plane or ground-counterpoise (34), said ground-plane of ground-counterpoise consisting, for example, on a wall of a waveguide or cavity resonator or a part of the structure of a motor vehicle (such as a car, a lorry, an airplane or a tank). The aperture can be fed by any of the conventional techniques such as a coaxial cable (11), or a planar microstrip or strip-line transmission line, to name a few.

Figure 16:
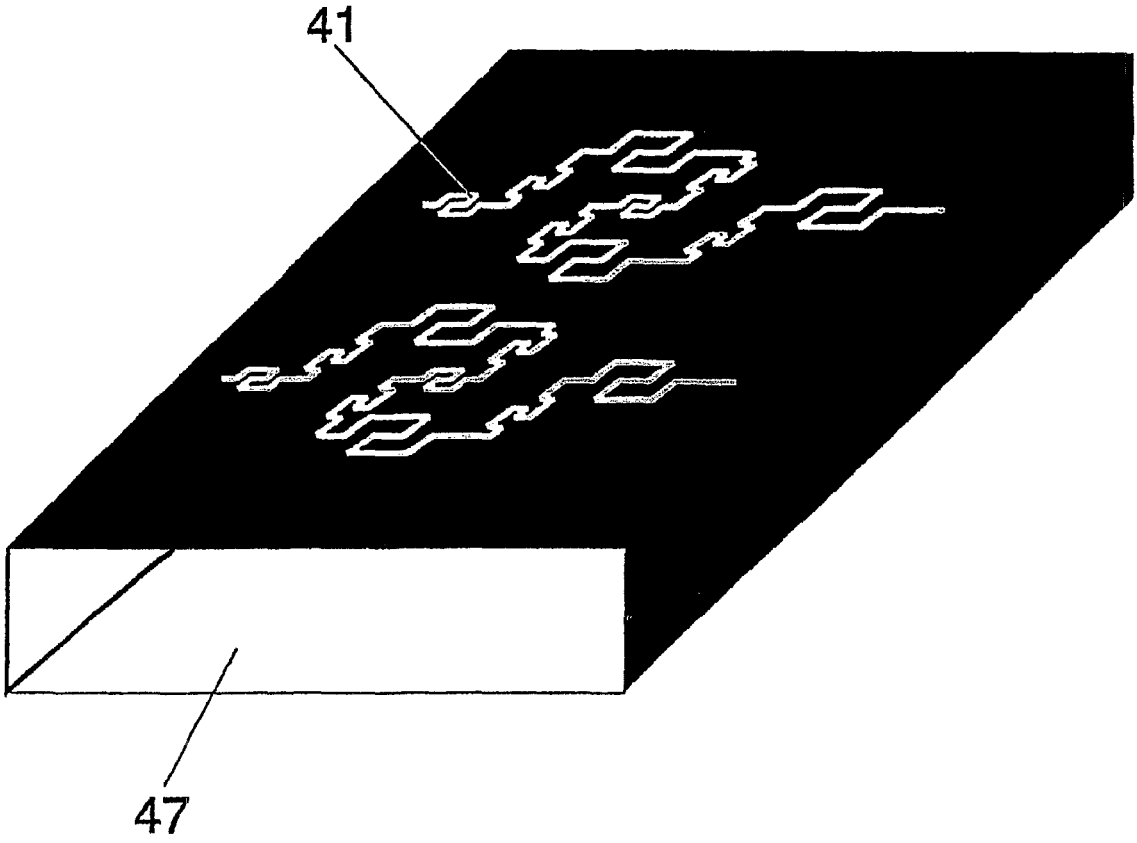
FIG. 16 shows a wave-guide slot antenna wherein a rectangular waveguide (47) has one of its walls slotted with SFC curve (41).

FIG. 16 shows another preferred embodiment where the SFC curves (41) are slotted over a wall of a waveguide (47) of arbitrary cross-section. This way and slotted waveguide array can be formed, with the advantage of the size compressing properties of the SFC curves.

Figure 17:
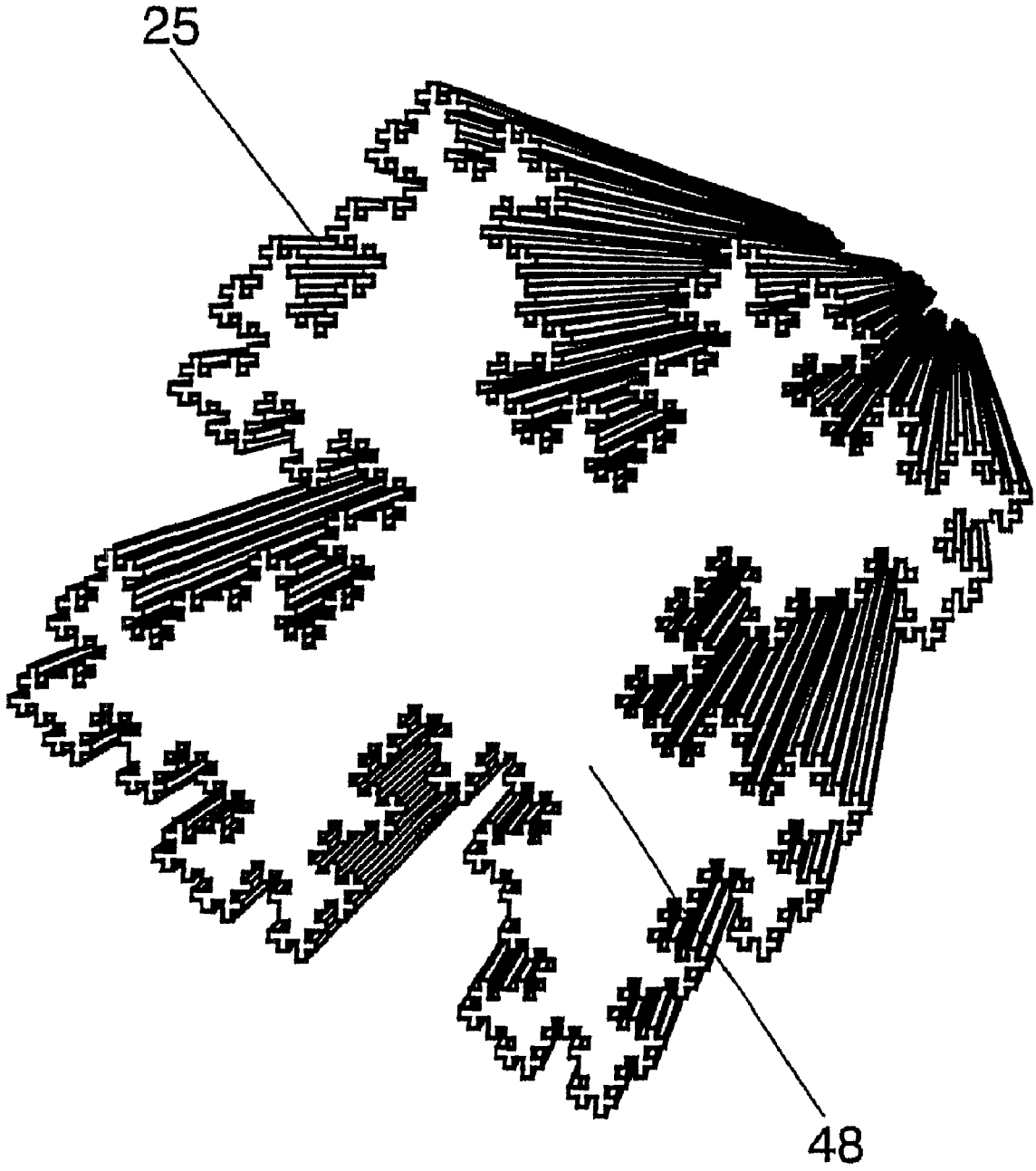
FIG. 17 shows a horn antenna, wherein the aperture and cross-section of the horn is shaped after SFC (25).

FIG. 17 depicts another preferred embodiment, in this case a horn antenna (48) where the cross-section of the antenna is an SFC curve (25). In this case, the benefit comes not only from the size reduction property of SFC Geometries, but also from the broadband behavior that can be achieved by shaping the horn cross-section. Primitive versions of these techniques have been already developed in the form of Ridge horn antennas. In said prior art cases, a single squared tooth introduced in at least two opposite walls of the horn is used to increase the bandwidth of the antenna. The richer scale structure of an SFC curve further contributes to a bandwidth enhancement with respect to prior art.

Figure 18:
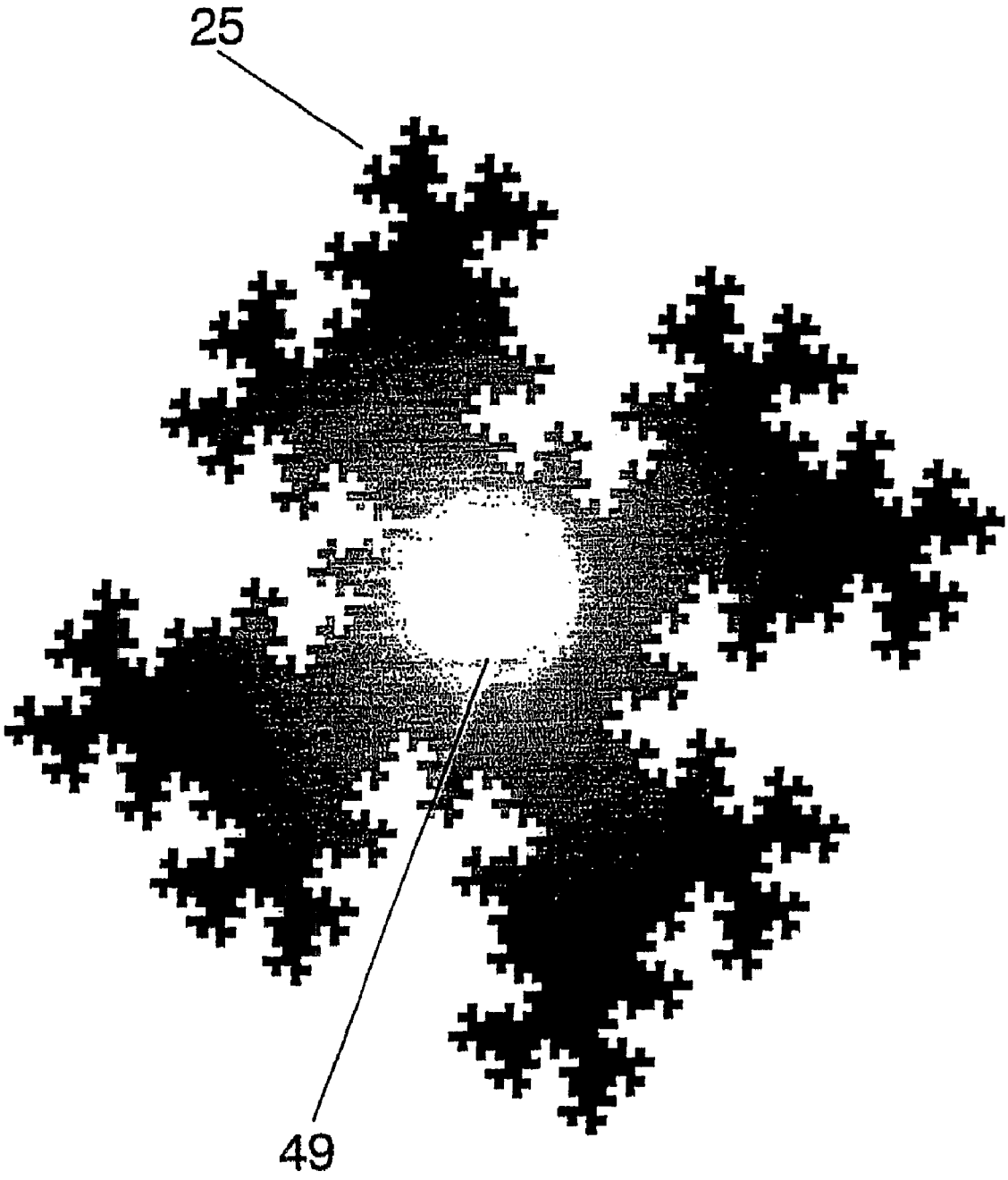
FIG. 18 shows a reflector of a reflector antenna wherein the perimeter of said reflector is shaped as SFC (25).
Figure 19:
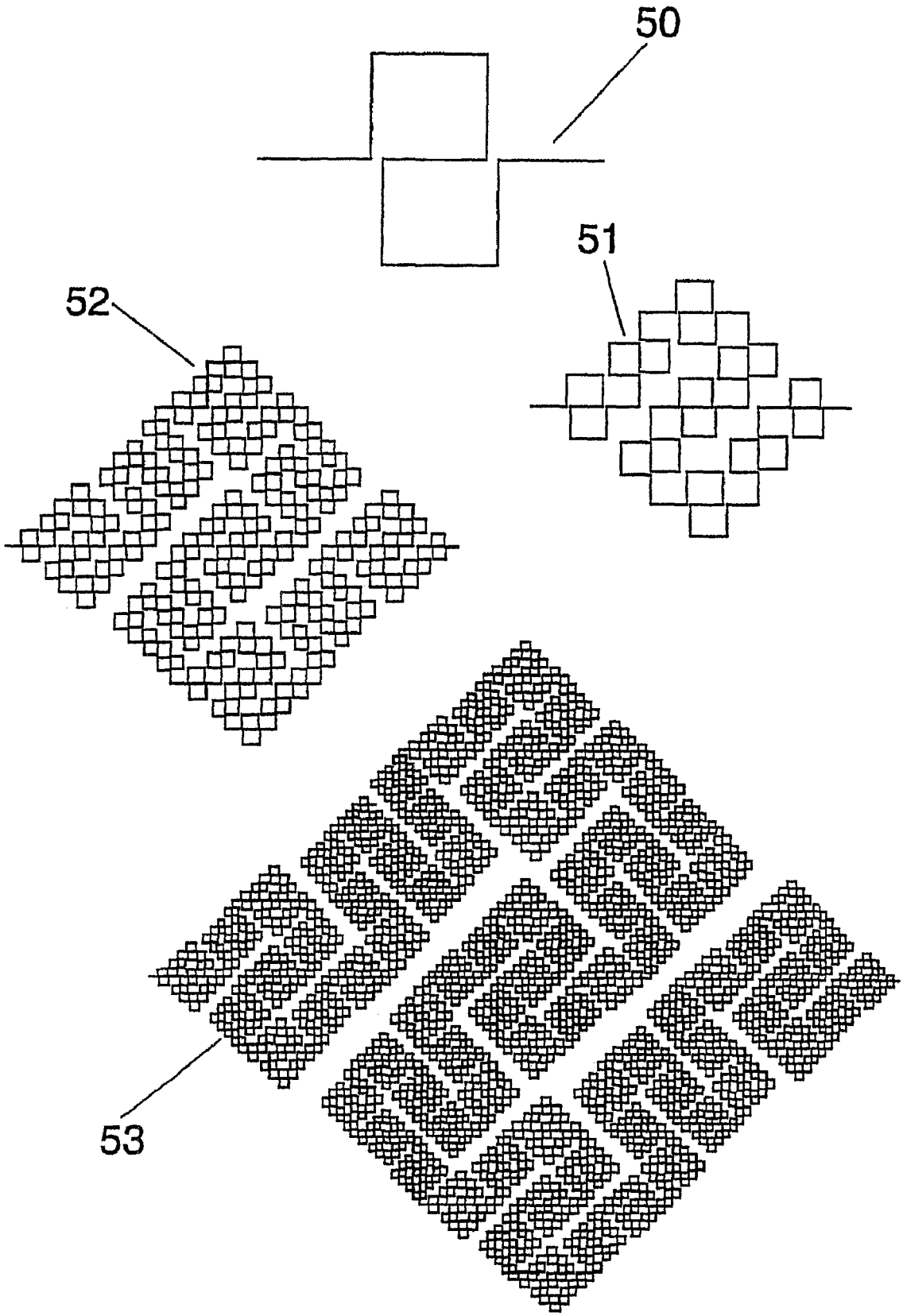
FIG. 19 shows a family of SFC curves (51, 52, 53) based on the Giusepe Peano curve. A non-SFC curve formed with only nine segments is shown for comparison (50).
Figure 20:
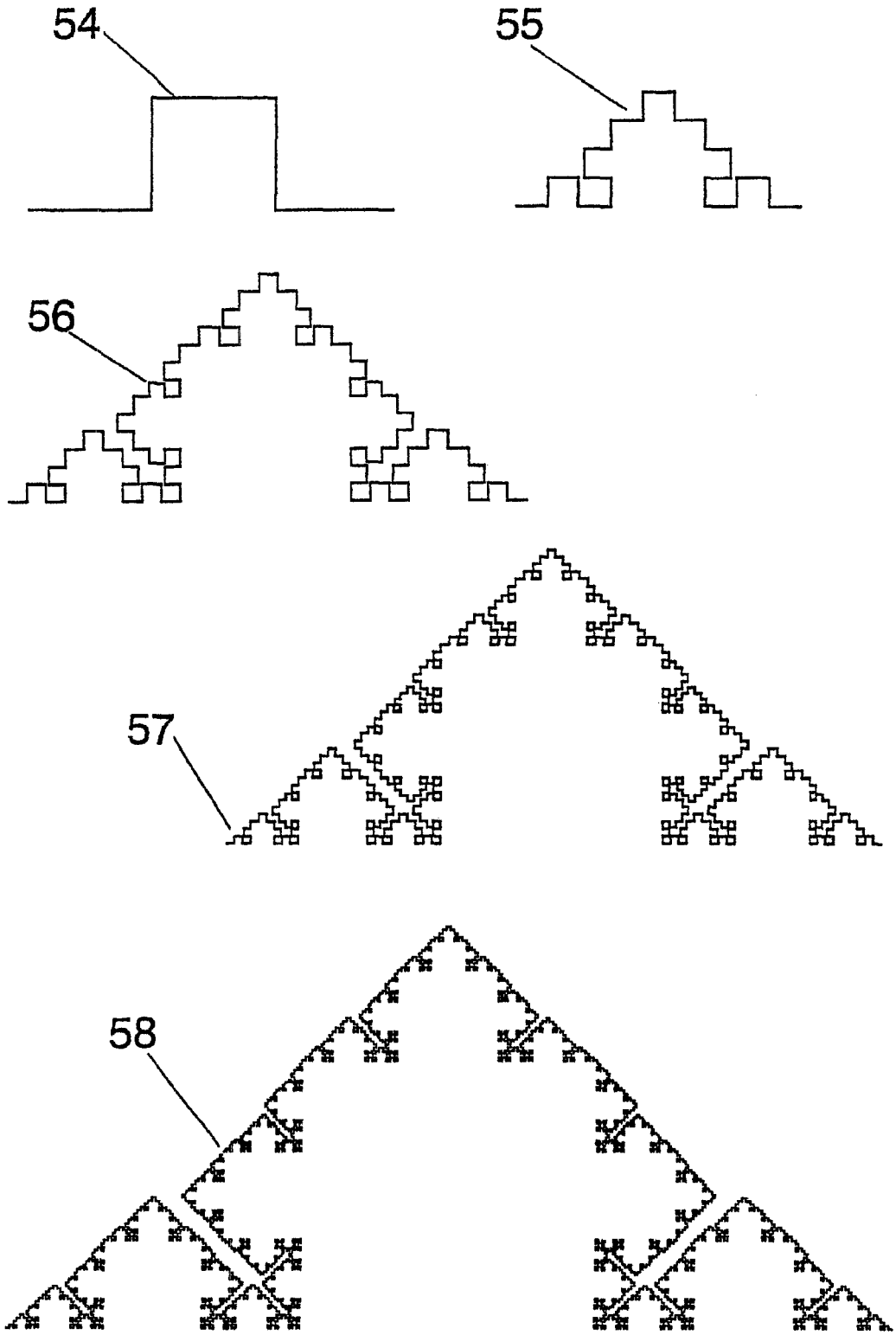
FIG. 20 shows another family of SFC curves (55, 56, 57, 58). A non-SFC curve (54) constructed with only five segments is shown for comparison.
Figure 21:
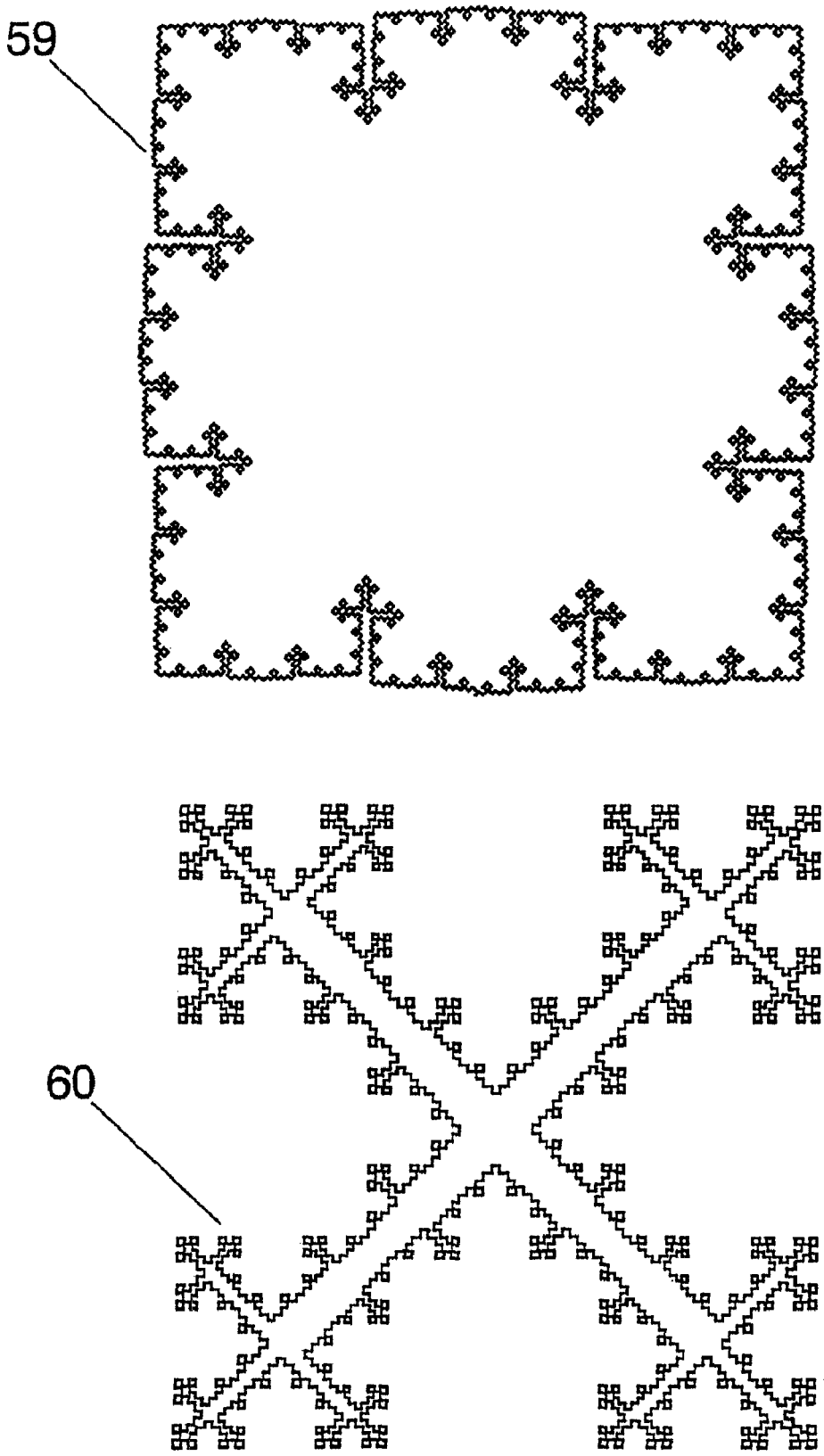
FIG. 21 shows two examples of SFC loops (59, 60) constructed with SFC (57).
Figure 22:
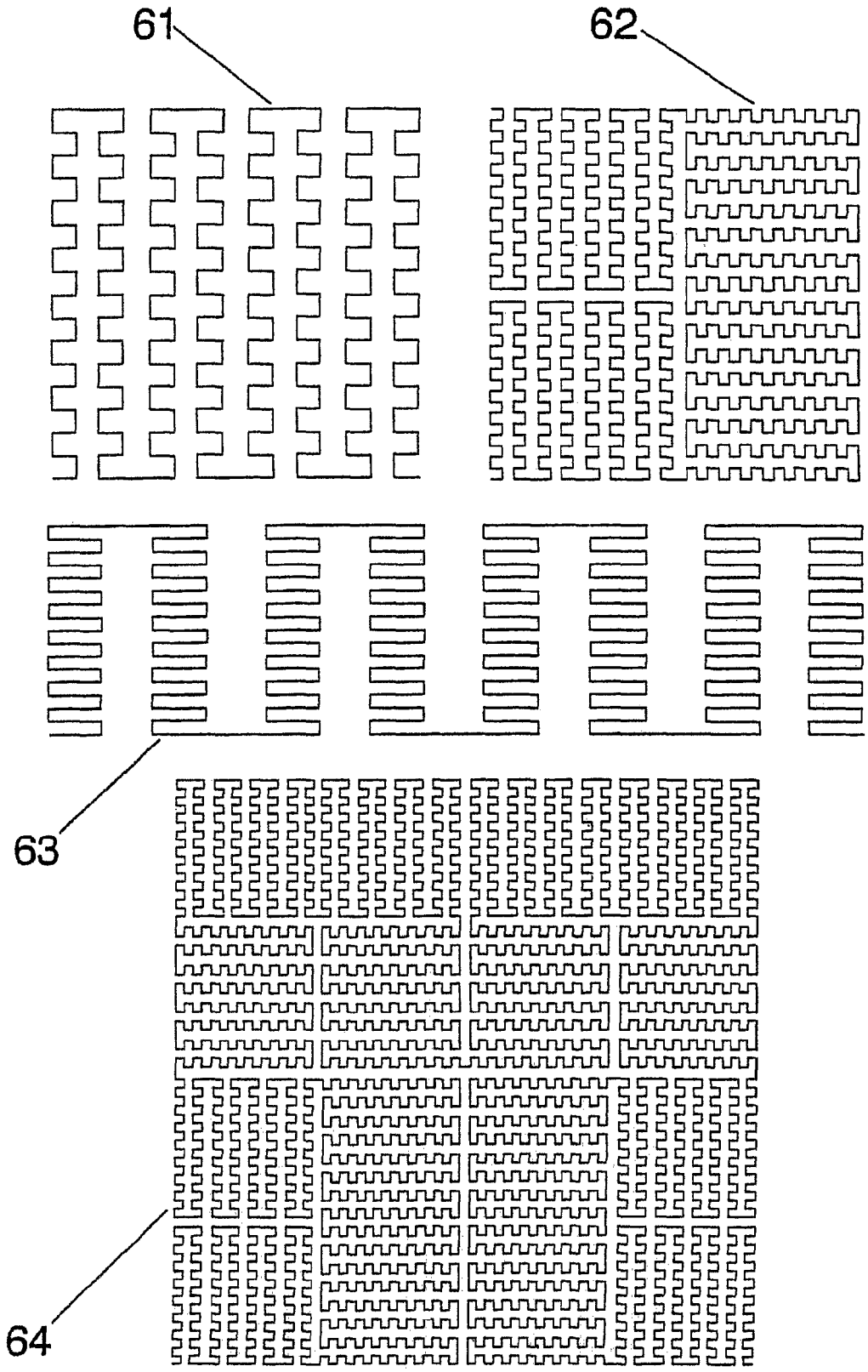
FIG. 22 shows a family of SFC curves (61, 62, 63, 64) named here as HilbertZZ curves.
Figure 23:
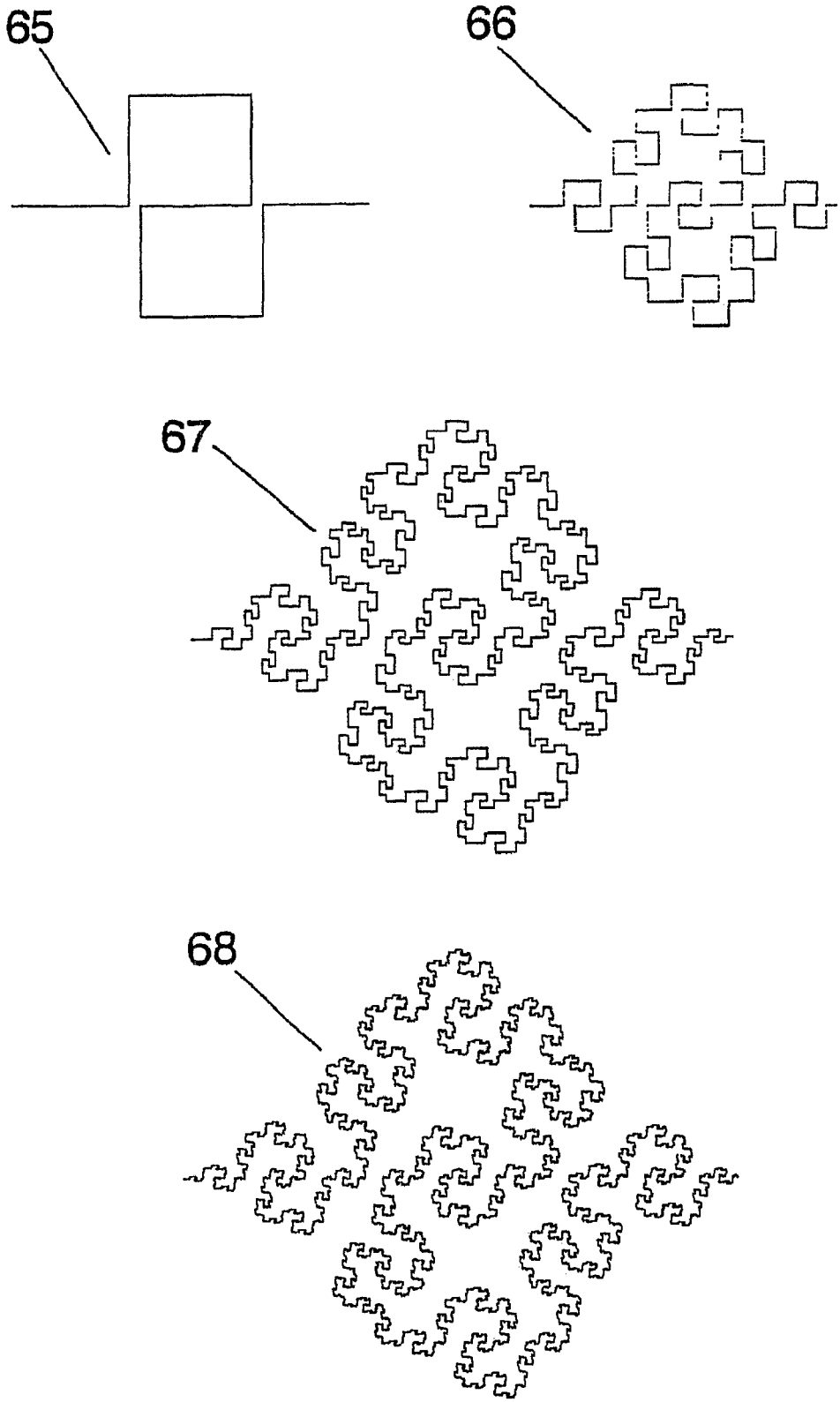
FIG. 23 shows a family of SFC curves (66, 67, 68) named here as Peanodec curves. A non-SFC curve (65) constructed with only nine segments is shown for comparison.
Figure 24:
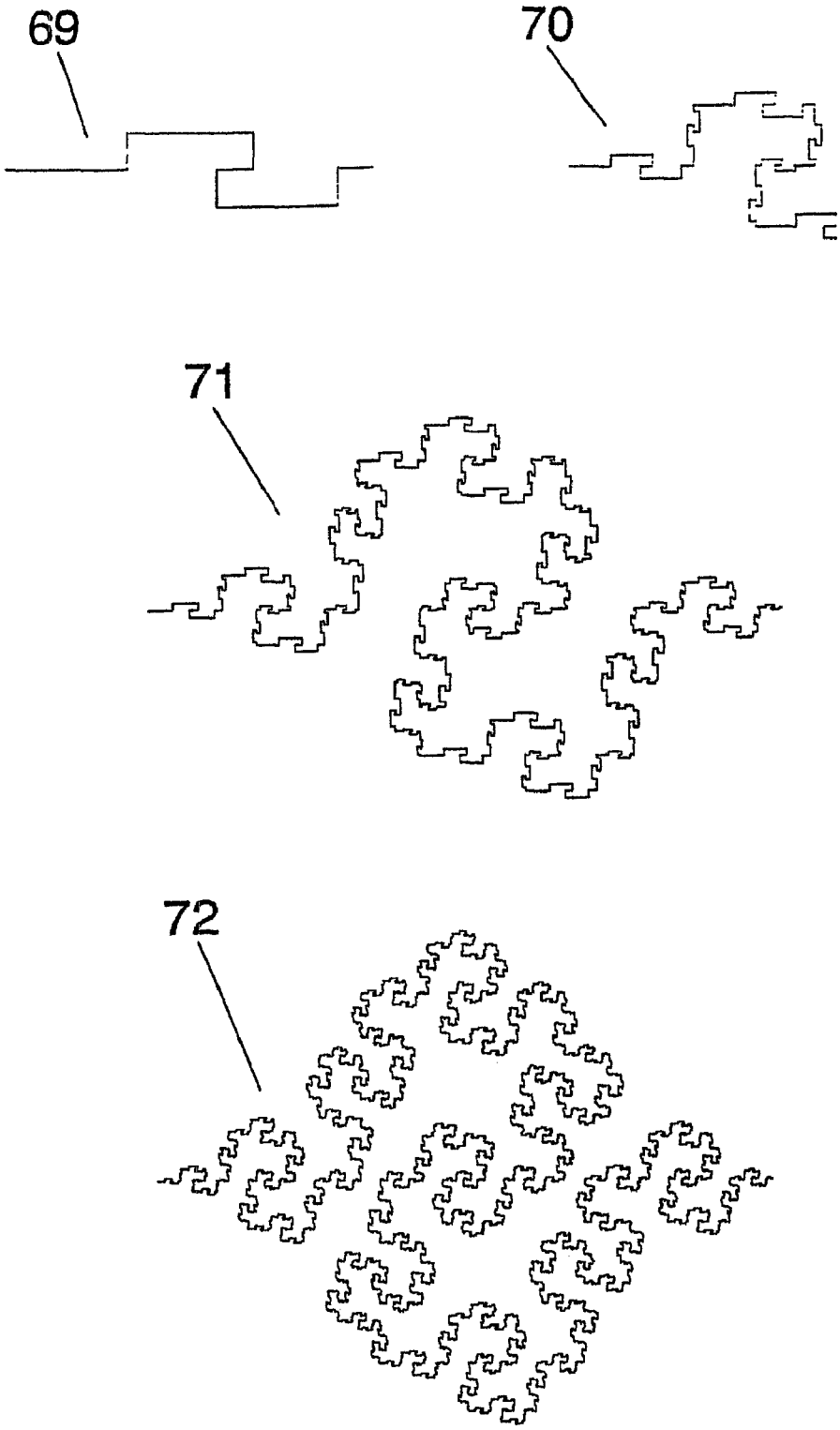
FIG. 24 shows a family of SFC curves (70, 71, 72) named here as Peanoinc curves. A non-SFC curve (69) constructed with only nine segments is shown for comparison.
Figure 25:
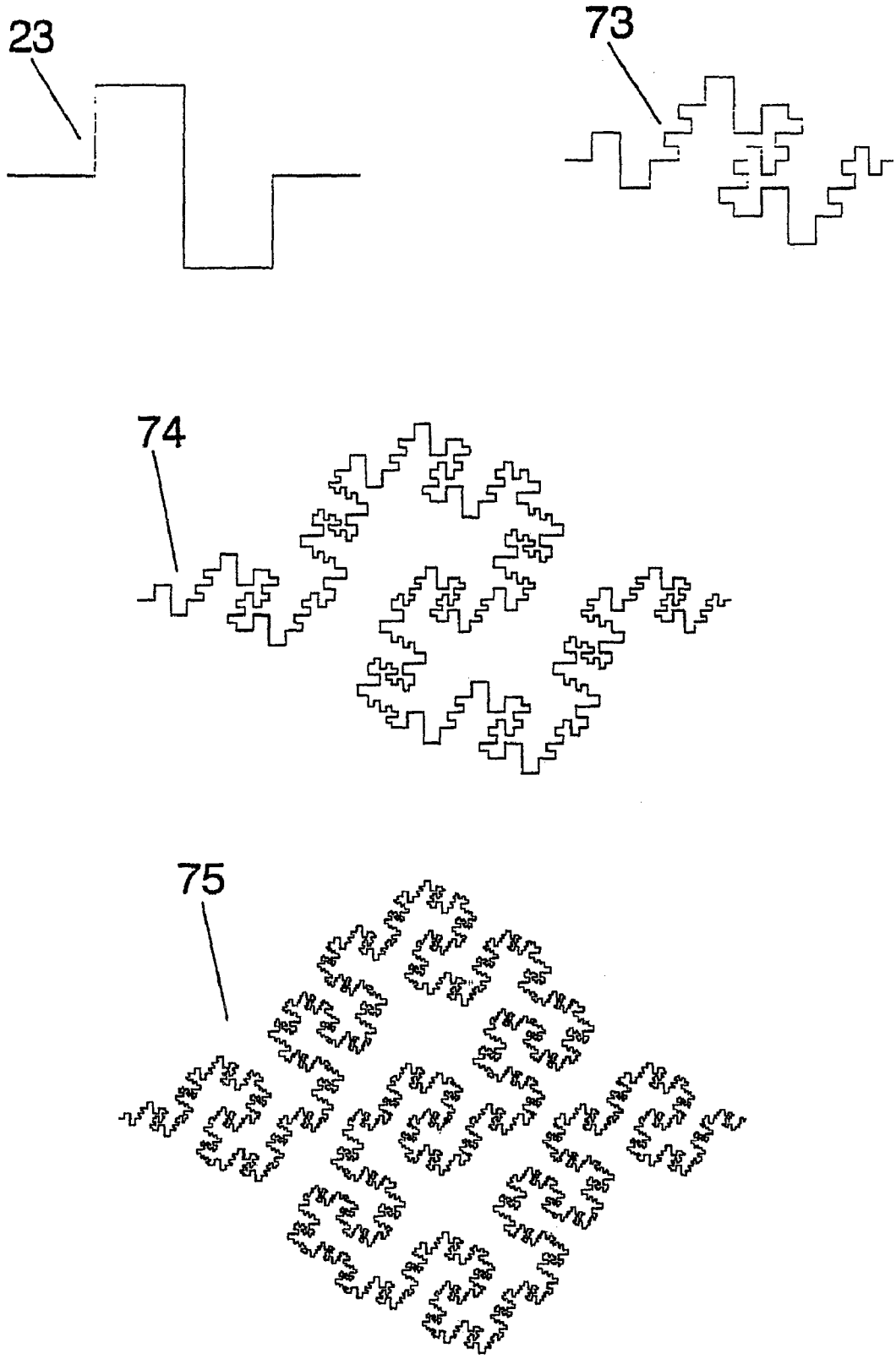
FIG. 25 shows a family of SFC curves (73, 74, 75) named here as PeanoZZ curves. A non-SFC curve (23) constructed with only nine segments is shown for comparison.

FIG. 18 describes another typical configuration of antenna, a reflector antenna (49), with the newly disclosed approach of shaping the reflector perimeter with an SFC curve. The reflector can be either flat or curve, depending on the application or feeding scheme (in for instance a reflectarray configuration the SFC reflectors will preferably be flat, while in focus fed dish reflectors the surface bounded by the SFC curve will preferably be curved approaching a parabolic surface). Also, within the spirit of SFC reflecting surfaces, Frequency Selective Surfaces (FSS) can be also constructed by means of SFC curves; in this case the SFC are used to shape the repetitive pattern over the FSS. In said FSS configuration, the SFC elements are used in an advantageous way with respect to prior art because the reduced size of the SFC patterns allows a closer spacing between said elements. A similar advantage is obtained when the SFC elements are used in an antenna array in an antenna reflectarray.

Having illustrated and described the principles of our invention in several preferred embodiments thereof, it should be readily apparent to those skilled in the art that the invention can be modified in arrangement and detail without departing from such principles. We claim all modifications coming within the spirit and scope of the accompanying claims.

The invention claimed is:

1. A method for producing light-weight, portable devices in the telecommunications field, comprising the steps of shaping at least a portion of an antenna as a space-filling curve for the light-weight, portable devices, implementing the antenna in the light-weight, portable devices and wherein said portable devices are selected from the group consisting essentially of handheld telephones, cellular telephones, cellular pagers, portable computers, data handlers.

2. A method according to claim 1, further including the step of operating the antenna of said portable device at a plurality of frequencies to give coverage to at least three communication services, wherein at least one of said communication services is selected from the group consisting essentially of cellular telephone services: GSM 900, GSM 1800, UMTS.

3. A method according to claim 1, wherein the antenna of said portable device gives coverage to at least one communication service.

4. A method according to claim 1, wherein the at least one communication service is UMTS.

5. A method according to claim 1, wherein the step of shaping further includes the step of shaping the antenna to include a multi-segment curve located completely within a radian sphere defined around the radiating element.

6. A method according to claim 5, wherein the step of shaping further includes the step of shaping the multi-segment curve such that no part of said multi-segment curve intersects another part of the multi-segment curve.

7. A method according to claim 5, wherein the step of shaping further includes the step of shaping the multi-segment curve such that no part of said multi-segment curve intersects another part other than at its beginning and end.

8. A method according to claim 5, wherein the step of shaping further includes the step of shaping the multi-segment curve such that said multi-segment curve features a box-counting dimension larger than 17.

9. A method according to claim 8, further including the step of computing the box-counting dimension as the slope of a substantially straight portion of a line in a log-log graph over at least an octave of scales on the horizontal axes of the log-log graph.

10. A method according to claim 5, wherein the step of shaping further includes the step of shaping the multi-segment curve such that the multi-segment curve forms a slot in a conductive surface of a radiating element.

11. A method according to claim 5, wherein the step of shaping further includes the step of shaping the multi-segment curve such that the multi-segment curve lies on a flat surface.

12. A method according to claim 5, wherein the step of shaping further includes the step of shaping the multi-segment curve such that the multi-segment curve lies on a curved surface.

13. A method according to claim 5, wherein the step of shaping further includes the step of shaping the multi-segment curve such that the multi-segment curve extends across a surface lying in more than one plane.

14. A method according to claim 5, wherein the step of shaping further includes the step of shaping the antenna to include a slot in a conducting surface, wherein said multi-segment curve defines the slot in the conducting surface, and wherein said slot is backed by a dielectric substrate.

15. A method according to claim 5, wherein the step of shaping further includes the step of shaping the antenna as a loop antenna comprising a conducting wire, and wherein at least a portion of the wire forming the loop is the multi-segment curve.

16. A method according to claim 5, wherein the step of shaping further includes the step of shaping the antenna as a slot or gap loop antenna comprising a conducting surface with a slot or gap loop impressed on said conducting surface, and wherein part of the slot or gap loop is the multi-segment curve.

17. A method according to claim 5, wherein the step of shaping the multi-segment curve further includes the step of printing the multi-segment wire over a dielectric substrate.

18. A method according to claim 5, wherein at least a portion of said antenna comprises a printed copper sheet on a printed circuit board.

19. A method according to claim 5, wherein the antenna is a patch antenna.

20. A method according to claim 5, wherein the step of shaping said multi-segment curve further includes the step of shaping the multi-segment curve to fill a surface that supports the multi-segment curve and wherein said multi-segment curve features a box-counting dimension larger than 17.

21. A method according to claim 5, wherein a portion of the multi-segment curve includes at least ten bends.

22. A method according to claim 5, wherein the radius of curvature of each of said at least ten bends is smaller of a tenth of the longest operating free-space wavelength of the antenna.

23. A method according to claim 5, wherein the step of shaping said multi-segment curve further includes the step of shaping an arrangement of a portion of said multi-segment curve to include bends not self-similar with respect to the entire multi-segment curve.

24. A method according to claim 5, wherein said multi-segment curve has a box-counting dimension larger than 1.2.

25. A method according to claim 5, wherein a portion of said multi-segment curve includes at least 25 bends.

* * * * *